US012071712B2

(12) United States Patent
Suzuki et al.

(10) Patent No.: US 12,071,712 B2
(45) Date of Patent: Aug. 27, 2024

(54) ECCENTRIC CORE-SHEATH COMPOSITE FIBER AND COMBINED FILAMENT YARN

(71) Applicant: Toray Industries, Inc., Tokyo (JP)

(72) Inventors: Norio Suzuki, Mishima (JP); Hideki Morioka, Mishima (JP); Masato Masuda, Mishima (JP)

(73) Assignee: Toray Industries, Inc., Tokyo (JP)

( * ) Notice: Subject to any disclaimer, the term of this patent is extended or adjusted under 35 U.S.C. 154(b) by 488 days.

(21) Appl. No.: 16/469,700

(22) PCT Filed: Dec. 12, 2017

(86) PCT No.: PCT/JP2017/044477
§ 371 (c)(1),
(2) Date: Jun. 14, 2019

(87) PCT Pub. No.: WO2018/110523
PCT Pub. Date: Jun. 21, 2018

(65) Prior Publication Data

US 2020/0087820 A1 Mar. 19, 2020

(30) Foreign Application Priority Data

Dec. 14, 2016 (JP) ..... 2016-242514
May 30, 2017 (JP) ..... 2017-106632

(51) Int. Cl.
*D01F 8/14* (2006.01)
*D02G 3/04* (2006.01)

(52) U.S. Cl.
CPC ..... *D01F 8/14* (2013.01); *D02G 3/04* (2013.01)

(58) Field of Classification Search
CPC .... D01F 8/14; D01F 8/04; D02G 3/04; D02G 3/045; D01D 5/22; D01D 5/34;
(Continued)

(56) References Cited

U.S. PATENT DOCUMENTS 2,987,797 A 6/1961 Breen
3,541,198 A 11/1970 Ueda et al.
(Continued)

FOREIGN PATENT DOCUMENTS

DE 22 50 496 A1 4/1974
JP 03269199 A * 11/1991
(Continued)

OTHER PUBLICATIONS

Machine Translation of JP 2003013354 A (Year: 2003).*
(Continued)

*Primary Examiner* — Jennifer A Steele
(74) *Attorney, Agent, or Firm* — DLA Piper LLP (US)

(57) ABSTRACT

A fiber material combines both stretchability and wear resistance, has a uniform and bump- and streak-free outer appearance, and has a smooth, delicate texture. The eccentric core-sheath composite fiber is characterized in that in the cross-section of a composite fiber composed of two different polymers, an A-component is completely covered by a B-component, a ratio S/D, or the minimum thickness S of the thickness of the B-component covering the A-component to a fiber diameter D, is 0.01 to 0.1, and a perimeter of a portion of fiber, where the thickness is 1.05 times or less the minimum thickness S, is at least one third of the perimeter of the fiber overall.

8 Claims, 4 Drawing Sheets

(58) Field of Classification Search
CPC ..... D01D 5/253; Y10T 428/2931; Y10T 428/2925; Y10T 428/2924; Y10T 428/2922
USPC ..... 428/374
See application file for complete search history.

(56) References Cited

U.S. PATENT DOCUMENTS

| | | | | |
|---|---|---|---|---|
| 3,642,565 | A | 2/1972 | Ogata et al. | |
| 5,164,262 | A * | 11/1992 | Kobayashi | D01F 8/16 428/374 |
| 6,306,499 | B1 | 10/2001 | Ochi et al. | |
| 2001/0055683 | A1 | 12/2001 | Ochi et al. | |
| 2006/0147709 | A1 | 7/2006 | Mizumura et al. | |
| 2007/0166509 | A1 | 7/2007 | Horiguchi et al. | |
| 2009/0004469 | A1* | 1/2009 | Yoshimoto | D01F 8/12 428/370 |
| 2009/0022989 | A1 | 1/2009 | Mizumura et al. | |

FOREIGN PATENT DOCUMENTS

| | | | |
|---|---|---|---|
| JP | 09-157941 | A | 6/1997 |
| JP | 2002-061031 | A | 2/2002 |
| JP | 2002-339169 | A | 11/2002 |
| JP | 2003-013354 | A | 1/2003 |
| JP | 2003013354 | A * | 1/2003 |
| JP | 2003-247139 | A | 9/2003 |
| JP | 2004-225227 | A | 8/2004 |
| JP | 2004-277918 | A | 10/2004 |
| JP | 2005-113369 | A | 4/2005 |
| JP | 2008-156762 | A | 7/2008 |
| JP | 2009-046785 | A | 3/2009 |
| JP | 2009-144277 | A | 7/2009 |
| JP | 2011-174215 | A | 9/2011 |
| JP | 2011-208313 | A | 10/2011 |
| JP | 2012-136804 | A | 7/2012 |
| JP | 2014-198917 | A | 10/2014 |
| JP | 2016-106188 | A | 6/2016 |
| KR | 10-2007-0001126 | A | 1/2007 |
| WO | 2006/025610 | A1 | 3/2006 |

OTHER PUBLICATIONS

Machine translation of JP 03269199 A (Year: 1991).*
Office Action dated May 26, 2020, of counterpart Taiwanese Application No. 106143970, along with an English translation.
The Extended European Search Report dated Jun. 22, 2020, of counterpart European Application No. 17882217.7.
Office Action dated Dec. 10, 2020, of counterpart Korean Application No. 10-2019-7016662, along with an English translation.
The Second Office Action dated Oct. 22, 2021, of counterpart Chinese Application No. 201780077595.2, along with an English translation.
Notice of Reasons for Refusal dated Nov. 9, 2021, of counterpart Japanese Application No. 2018-507736, along with an English translation.
The Examination Report dated Nov. 26, 2021, of counterpart Indian Patent Application No. 201947023465.
Notice of Reasons for Refusal dated Apr. 19, 2022, of counterpart Japanese Patent Application No. 2018-507736, along with an English translation.
Office Action dated Apr. 27, 2023, of counterpart Vietnamese Patent Application No. 1-2019-03115, along with an English translation.
International Preliminary Report on Patentability dated Jun. 18, 2019, of counterpart International Application No. PCT/JP2017/04477, along with an English translation.

* cited by examiner

ECCENTRIC CORE-SHEATH COMPOSITE FIBER AND COMBINED FILAMENT YARN

TECHNICAL FIELD

This disclosure relates to a core-sheath composite fiber, more particularly, to an eccentric core-sheath composite fiber having latent crimpiness based on a shrinkage difference between two different ingredients, satisfactory wear resistance, and can provide fabric characteristics with an excellent appearance that is even and smooth and free from crinkles and streaks.

The disclosure further relates to a mixed-filament yarn including a filament bundle made up of two or more kinds of intermingled single filaments differing in cross-sectional configuration, the mixed-filament yarn being suitable for woven or knit fabrics having stretchability and, despite this, having a puffy and comfortable touch and a natural grainy appearance.

BACKGROUND

Fibers formed from thermoplastic polymers such as polyesters and polyamides have various excellent properties including mechanical properties and dimensional stability. Hence, such fibers are used not only in clothing applications, but also in various fields including interior decoration, interior parts for vehicles, and industrial materials. With the diversification of applications of the fibers, required properties have come to be various.

Especially nowadays, garments have come to be required to be inhibited from giving a tight sense of wear and conform to movements, and stretchability is highly required of garments and the like. Furthermore, a combination of functions such as aesthetic properties, feeling, lightweight properties, bulkiness, and coloration is additionally required, and feeling, which is a characteristic of yarns having enhanced fineness, in particular aesthetic properties, a smooth feeling, and softness are highly required.

Various methods of imparting stretchability to raw yarns to be used to constitute fabrics have been proposed. There is a method in which a fiber that has been false-twisted and has twisting/untwisting torque thus imparted is used to produce a woven or knit fabric having stretchability. However, there has been a problem in that the torque tends to form crinkles in the surface of the woven fabric and is apt to result in woven-fabric defects. To mitigate this drawback, a torque balance is attained by performing a heat treatment or S/Z twisting to balance stretchability with defects due to crinkles. However, that technique has a problem in that, in most cases, stretchability considerably decreases.

There also is a method in which polyurethane-based fibers having rubber elasticity are incorporated into a woven fabric to impart stretchability. However, there has been a problem in that polyurethane-based fibers have a stiff feeling, which is a property inherent in polyurethanes, and the woven fabric is inferior in feeling and drape property. Furthermore, polyurethane-based fibers are difficult to dye with dyes for polyesters, and even when the polyurethane-based fibers are used with polyester fibers, dyeing step becomes complicated and it is still difficult to dye in a desired color.

For use in methods in which neither polyurethane-based fibers nor a false-twist textured yarn is used, various fibers having latent crimpiness which utilize side-by-side compositing have been proposed. The term "fiber having latent crimpiness" means a fiber having the ability to become crimpy upon heat treatment or the ability to come, upon heat treatment, to have crimpiness finer than that before the heat treatment. Such fibers are distinguished from textured yarns such as false-twist textured yarns, in which the fibers have been mechanically made to memorize bending.

For example, JP-A-H09-157941 proposes a composite fiber having latent crimpiness, which is a composite fiber obtained by bonding two polymer ingredients differing in viscosity in a side-by-side arrangement.

When the composite fiber having latent crimpiness is used, the fiber bends considerably toward the high-shrinkage-ingredient side upon heat treatment. Since such bending occurs consecutively, the fiber has a three-dimensional spiral structure. The structure expands and contracts like a spring, and stretchability can hence be imparted to the fabric.

However, the composite fiber proposed in JP '941 has a problem in that since the structure is formed by mere bonding, interfacial separation occurs due to friction or impacts to partly cause whitening, which is the phenomenon in which white streaks are formed, and fluffing and the like, resulting in a decrease in fabric appearance quality. The single-filament fineness is 4.1 d (4.6 dtex) at the most and the fabric has enhanced tightness or stiffness and sometimes gives a stiff sense. In addition, there are instances where the fabric gives a tight sense of wear due to the excessive stretchability.

JP-A-2016-106188 proposes a crimpy composite short fiber having a fiber including a first ingredient and a second ingredient and in the cross-section of which the center of gravity of the second ingredient has been dislocated from the center of gravity of the fiber.

Filament bending during ejection is inhibited in producing a fiber having such a cross-section, and a crimpy composite short fiber having a satisfactory touch with wavy crimpiness and spiral crimpiness is obtained. However, the number of crimp waves is 16 per 25 mm at the most, which is substantially the same as the number of crimp waves attained by a treatment of an ordinary fiber not having latent or actual crimpiness, with a stuffing box crimper. Consequently, the proposed composite fiber, which is a mere eccentric core-sheath composite fiber, in the crimpy state is poor in the important property of stretchability and cannot be a material having satisfactory stretchability. In addition, there is a problem in that a slight positional deviation of the eccentric core ingredient causes crimpiness unevenness and this results in crinkles or streaks. There also is a problem in that enhanced fineness results in poorer stretchability.

Meanwhile, polyester fibers including poly(trimethylene terephthalate) as a main component have excellent softness due to the high recovery from elongation and low Young's modulus thereof. By applying such polyester fibers to a side-by-side composite fiber, a stretchable material having softness as an added value can be obtained. Investigations thereon are hence being made enthusiastically in a wide range of applications, including clothing applications and non-clothing applications.

For example, JP-A-2002-339169 and JP-A-2002-061031 indicate that when a fiber including two polyester-based polymers, at least one of these being a polyester including poly(trimethylene terephthalate) as a main component, is used, a fabric having high bulkiness and excellent ability to exhibit crimpiness and having high appearance quality and excellent soft stretchability can be obtained.

However, the fibers proposed in JP '169 and JP '031 have a problem in that since the fibers also have a structure formed by mere bonding, interfacial separation occurs due to friction or impacts to partly cause whitening, which is the phenomenon in which white streaks are formed, and fluffing and the like, resulting in a decrease in fabric appearance quality. In addition, since poly(trimethylene terephthalate) has lower heat resistance than poly(ethylene terephthalate), the polymer itself is problematic. Because of this, formation of finer filaments, which results in an increase in specific surface area, renders the production disadvantageous with respect to heat resistance. There has been a problem in that the exposed polymer which has been thermally affected in a later step causes fluffing or other defects upon abrasion or the like, resulting in a decrease in fabric appearance quality. When fineness enhancement is attempted in this method, filament bending occurs just after ejection from the spinneret and, hence, the single-filament fineness in the Examples is about 2.3 dtex.

On the other hand, natural fibers such as wool and cotton typically have a small fiber length and are hence used after processing in which several short fibers are put together into one long yarn (spinning). This one spun yarn is composed of short fibers differing in response to heat or water, and is formed, through high-order processing, into a woven or knit fabric having a comfortable touch with bulkiness or puffiness due to differences in fiber length and having excellent hygroscopicity and heat-retaining properties due to the complicated fiber structure peculiar to the natural material. Because of this, the natural fibers, when used to produce woven or knit fabrics, provide excellent comfortableness of wear.

Those fabrics, besides having such functions, have a natural appearance with a fascinating preferred uneven sense, because of the properties of the constituent short fibers and because of differences in thickness or shape among the individual spun yarns. Even nowadays, natural fibers are extensively used in applications including inner wear and outer wear.

However, due to the recent abnormal weather and epidemics, the supply of natural fibers fluctuates considerably. Not only the rising cost of natural fibers, but also the unstable supply is becoming problematic. In addition, use of natural fibers necessitates many steps including sorting, disinfection, and degreasing. Natural-looking materials based on synthetic fibers capable of stable supply are being developed enthusiastically.

Synthetic fibers constituted of thermoplastic polymers such as polyesters and polyamides are characterized in that the synthetic fibers have high basic properties such as mechanical property and dimensional stability and are excellent in terms of balance among these.

It is not too much to say that in the development of novel techniques concerning synthetic fibers, technical innovations have been made with a motivation for imitating natural materials. Various technical proposals have been made over a prolonged period so that a function derived from a natural complicated structural morphology is provided with a synthetic fiber. There are various such techniques including, for example, a technique of providing a peculiar feeling (creakiness, flexibility) by imitating the cross-section of silk.

It can be seen from recent developments of synthetic fibers that there is a desire for not only a natural appearance, but also a reduced tight sense of wear and conformability to movements. The so-called stretch materials having stretchability, which cannot be imparted by the mere twisting performed in spinning natural fibers or by crimping and the like, are being developed enthusiastically.

Various methods of imparting stretchability to raw yarns composing fabrics have been proposed. There are a method in which a fiber which has been false-twisted and has twisting/untwisting torque thus imparted is used and a method in which polyurethane-based fibers having rubber elasticity are incorporated into a woven fabric. However, such methods have problems, for example, in that the stretchability is insufficient and the incorporation of another material renders the dyeing step complicated.

To overcome those problems, techniques relating to a fiber having latent crimpiness have been disclosed. This fiber is produced by bonding different polymers in a side-by-side arrangement and is made to exhibit a spiral structure by utilizing a difference in shrinkage therebetween.

For example, JP-A-2014-198917 proposes a fiber having latent crimpiness which is a side-by-side composite fiber including poly(ethylene terephthalate) (PET) polymers differing in intrinsic viscosity or limiting viscosity. JP-A-2005-113369 proposes a fiber having latent crimpiness which is a side-by-side composite fiber in which poly(trimethylene terephthalate) (PTT) and PET are utilized.

In those fibers having latent crimpiness, a difference in the degree of shrinkage between the polymers is utilized to make the single filament to form a three-dimensional spiral structure. Fibers having stretchability are thus obtained.

However, when such fibers having latent crimpiness are used alone, when the fabric is dyed, the dyed fabric has an even and dull color tone, and it has hence been extremely difficult to produce a difference in depth of color such as those obtained with natural fibers. There have also been instances where since the synthetic fibers have a glossy sense peculiar thereto, the fabric undesirably has shine and an unnatural appearance. In addition, when such fibers having latent crimpiness are used alone, the fabric has a poorly puffy feeling because the filaments have been relatively tightly bundled.

A mixed-filament yarn obtained by mixing, for example, fibers differing in shrinkability or dyeability has been proposed to impart a soft feeling due to graininess and puffiness such as those of natural fibers to fibers having latent crimpiness.

For example, JP-A-2003-247139 and JP-A-2004-225227 indicate that not only impartation of stretchability but also impartation of a puffy sense due to a difference in fiber length and production of graininess are rendered possible by separately spinning a fiber having latent crimpiness and a fiber differing in dyeability therefrom and thereafter mixing the fibers in another step.

However, such a mixed-filament yarn produced through filament mixing after spinning has a drawback in that the dispersion of the constituent single filaments in the mixed-filament yarn is not satisfactory and single filaments having the same composition localize in the mixed-filament yarn. In dyeing a fabric obtained from the mixed-filament yarn, a difference in depth of color may be clear since only one kind of fibers floats on the surface, which makes it difficult to produce natural and mellow graininess.

In addition, the mixed-filament yarn produced through filament mixing after spinning is prone to suffer sagging or splitting because the filaments have been loosely bundled, and when fluffing, filament breakage, or yarn breakage occurs to impair the passability in high-order processing, resulting in a problem concerning fluffing, dyeing unevenness and the like. Although it may be possible to use an interlace nozzle or the like to promote the dispersion of the constituent single filaments by interlacing, it is necessary to perform excessive interlacing for sufficiently dispersing the single filaments and there are hence instances where filament breakage or the like occurs to reduce the yarn strength or the passability in high-order processing.

It could therefore be helpful to provide a fabric that retains sufficient stretchability and wear resistance and has an even and smooth appearance free from crinkles and steaks, and to further provide a fiber material sufficient stretchability and a comfortable touch and/or natural graininess in accordance with a color tone difference by controlling and improving the dispersion of single filaments as a component of a mixed-filament yarn.

SUMMARY

We thus provide:

(1) An eccentric core-sheath composite fiber including two kinds of polymers that are ingredient A and ingredient B, in which, in a cross-section of the composite fiber: the ingredient A is covered entirely by the ingredient B; a ratio S/D of a minimum thickness S of a thickness of the ingredient B, which covers the ingredient A, to a fiber diameter D is from 0.01 to 0.1; and a portion where the ingredient B has a thickness up to 1.05 times the minimum thickness S has a peripheral length of at least one-third entire circumferential length of the fiber.

(2) The eccentric core-sheath composite fiber according to (1), having a stretching elongation of from 20 to 70%, in which at least one of the two ingredients is a polyester.

(3) The eccentric core-sheath composite fiber according to (1) or (2), having a single-filament fineness of 1.0 dtex or less and a fineness unevenness (U %) of 1.5% or less.

(4) A mixed-filament yarn including two or more kinds of single filaments having different cross-sectional configuration and dispersedly intermingled with each other, in which: at least one kind of the single filaments includes the eccentric core-sheath composite fiber according to (1) including a combination of two polymers differing in melt viscosity by 50 Pa·s or more; and the at least one kind of the single filaments is bundled with the other of the single filaments with the number of tangles being from 1 to 100/m.

(5) A mixed-filament yarn including two or more kinds of single filaments having different cross-sectional configuration and dispersedly intermingled with each other, in which: at least one kind of the single filaments includes a composite fiber including a combination of two polymers that are different in melt viscosity by 50 Pa·s or more; and the at least one kind of the single filaments is bundled with the other of the single filaments with the number of tangles being from 1 to 100/m.

(6) The mixed-filament yarn according to (4) or (5), in which the composite fiber has an eccentric core-sheath composite cross-section and a three-dimensional spiral structure.

(7) The mixed-filament yarn according to any one of (4) to (6), in which the other of the single filaments is a single-component fiber constituted of a single component.

(8) The mixed-filament yarn according to any one of (4) to (7), in which the composite fiber accounts for 30% or more and 80% or less by weight of the mixed-filament yarn.

(9) A fibrous product including the mixed-filament yarn according to any one of (4) to (8) as at least a part of the fibrous product.

Our eccentric core-sheath composite fiber is a composite fiber having latent crimpiness, that has sufficient stretchability, is inhibited from suffering separation at the bonding interface, and has improved wear resistance.

In the eccentric core-sheath composite fiber, ingredient A is entirely covered by ingredient B. Because of this, the composite fiber can provide a fabric which has stretchability and wear resistance and has an even and smooth appearance free from crinkles and streaks.

Furthermore, the mixed-filament yarn can provide, with satisfactory passability in high-order processing, a woven or knit fabric which has both a feeling (comfortable touch) due to differences in length among the evenly dispersed and intermingled single filaments and stretchability and which, despite this, has a spun-looking natural appearance that shows, for example, graininess depending on color tone differences.

Figure 1:
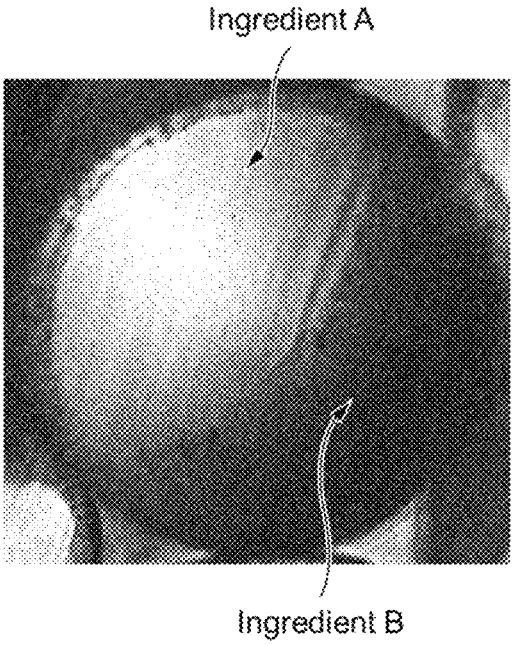
FIG. 1 is a drawing-substitute photograph which shows one example of the cross-section of an eccentric core-sheath composite fiber.

REFERENCE SIGNS LIST a: Center of gravity of ingredient A in composite-fiber cross-section C: Center of gravity of composite-fiber cross-section S: Minimum thickness of ingredient B D: Fiber diameter IFR: Radius of curvature of interface between ingredient A and ingredient B in composite-fiber cross-section

1-(*a*), (b): Examples of single filaments of same kind adjoining each other in cross-section of mixed-filament yarn

1-(*c*): Example of adjacent-filament groups in cross-section of mixed-filament yarn

5-(*a*): Distribution holes, of the distribution holes of final distribution plate, for ingredient B for forming thin-wall portion

5-(*b*): Distribution holes, of the distribution holes of final distribution plate, for ingredient B, other than 5-(*a*)

5-(*c*): Distribution holes, of the distribution holes of final distribution plate, for ingredient A

DETAILED DESCRIPTION

Our fibers and yarns are described below together with desirable examples thereof.

The eccentric core-sheath composite fiber has a cross-section including two polymers that are ingredient A and ingredient B.

Polymers suitable for use here are thermoplastic polymers having fiber-forming properties. Suitable is a combination of polymers that, upon heat treatment, come to have a difference in shrinkage. Suitable is a combination of polymers that differ in molecular weight or composition to differ in melt viscosity by 10 Pa·s or more.

Suitable example of polymers include poly(ethylene terephthalate), poly(ethylene naphthalate), poly(butylene terephthalate), poly(trimethylene terephthalate), polyamides, poly(lactic acid), thermoplastic polyurethanes, and poly (phenylene sulfide). It is possible to prepare any of these polymers in two grades differing in molecular weight and to use the high-molecular-weight polymer as ingredient A shown in FIG. 2 and the low-molecular-weight polymer as ingredient B shown therein. Alternatively, it is possible to use a homopolymer as one of the ingredients and a copolymer as the other ingredient.

Examples of the combination of polymers differing in composition include various ingredient A/ingredient B combinations such as poly(butylene terephthalate)/poly(ethylene terephthalate), poly(trimethylene terephthalate)/poly(ethylene terephthalate), thermoplastic polyurethane/poly(ethylene terephthalate), and poly(trimethylene terephthalate)/poly(butylene terephthalate). With these combinations, satisfactory bulkiness due to a spiral structure can be obtained.

In particular, it is preferred to use polyesters, polyamides, polyethylene, polypropylene and the like. More preferred of these are polyesters because polyesters further have mechanical properties and the like. Examples of the polyesters include not only poly(ethylene terephthalate), poly (butylene terephthalate), and poly(propylene terephthalate) but also polymers obtained by copolymerizing a dicarboxylic acid ingredient, a diol ingredient, or a oxycarboxylic acid ingredient with any of these polyesters and blends of two or more of these polyesters.

Also usable are aliphatic polyesters known as biodegradable polyesters such as poly(lactic acid), poly(butylene succinate), and poly-ε-caprolactam. Ingredients such as a delustering agent, e.g., titanium oxide, a flame retardant, a lubricant, an antioxidant, and a coloring pigment, e.g., fine inorganic particles, an organic compound, or carbon black, can be incorporated into those polymers according to need so long as the incorporation thereof does not adversely affect the desired effect.

In the cross-section of the eccentric core-sheath composite fiber, the areal proportions of the composited ingredient A and ingredient B are as follows. From the standpoint of the development of crimpiness, a fine spiral structure can be attained when the proportion of ingredient A, which is a high-shrinkage ingredient, is larger. Meanwhile, the eccentric core-sheath composite fiber by itself needs to have excellent physical properties. Consequently, the proportions of the two ingredients are such that the (ingredient A):(ingredient B) ratio is preferably 70:30 to 30:70 (areal ratio), more preferably 65:35 to 45:55.

The composite fiber needs to have a composite cross-section where two different polymers have been bonded to each other. The two polymers that differ in polymer property need to be bonded to each other without undergoing substantially no separation therebetween. The cross-section needs to be of the eccentric core-sheath type in which ingredient B entirely covers ingredient A.

The term "eccentric" herein means that in the cross-section of the composite fiber, the center of gravity of the ingredient A polymer is dislocated from the center of the cross-section of the composite fiber. This is explained using FIG. 2.

Figure 2:
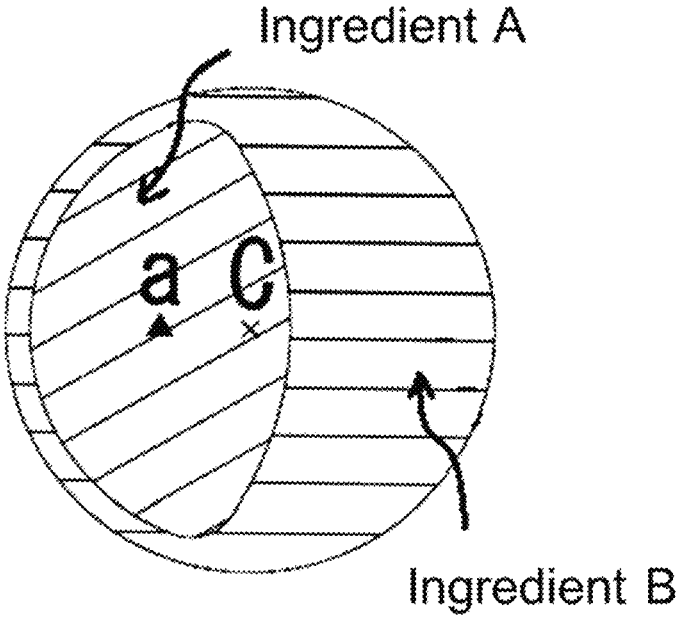
FIG. 2 is a cross-section of an example of the eccentric core-sheath composite fiber, and illustrates the positions of centers of gravity in the fiber cross-section.

In FIG. 2, the portion indicated by horizontal hatching is ingredient B and the portion indicated by 30-degree hatching (rightward rising slant lines) is ingredient A. The center of gravity of ingredient A in the cross-section of the composite fiber is indicated by "a" and the center of gravity of the cross-section of the composite fiber is indicated by C.

It is important that the center of gravity "a" should be apart from the center of gravity C of the cross-section of the composite fiber. This configuration makes the fiber bend considerably toward the high-shrinkage-ingredient side upon heat treatment. This bending of the composite fiber occurs consecutively along the fiber axis direction, and the composite fiber thus comes to have a three-dimensional spiral structure to show satisfactory crimpiness. The more the centers of gravity are apart from each other, the better the crimpiness to be developed and the better the stretchability to be obtained.

Since ingredient B entirely covers ingredient A, the fiber or the fabric does not suffer whitening, fluffing, or the like even upon friction or impacts. The fabric can hence retain the appearance quality. In addition, the high-molecular-weight polymers, high-modulus polymers and the like, which are exposed in the surface to become defects in the composite fiber when used in the conventional structure formed by mere bonding, can be used as one of the ingredients constituting the composite fiber.

Since ingredient A, which is one of the polymers, is entirely covered by ingredient B, which is the other polymer, this composite fiber further has an effect of satisfactorily maintaining the fiber properties even when, for example, a polymer having low heat or wear resistance or a polymer having hygroscopicity is used.

The eccentric core-sheath composite fiber that provides the effects described above needs to satisfy the following: the ratio of the minimum thickness S of ingredient B, by which ingredient A is covered, to the fiber diameter (diameter of the composite fiber) D, S/D, is 0.01 to 0.1. The ratio S/D is preferably 0.02 to 0.08. When the ratio S/D is within that range, the fabric can be inhibited from decreasing in appearance quality due to fluffing and the like and it is possible to obtain a sufficient ability to develop crimpiness and sufficient stretchability.

A crimped yarn essentially can have satisfactory stretchability when the polymers are in contact with each other at the bonding interface only, and when the high-shrinkage ingredient is covered by the low-shrinkage ingredient, this yarn has poor stretchability. However, as a result of investigations, it is possible to obtain a composite fiber that satisfies the two properties of stretchability and wear resistance, by regulating ingredient B to have a thickness within our range.

Figure 3:
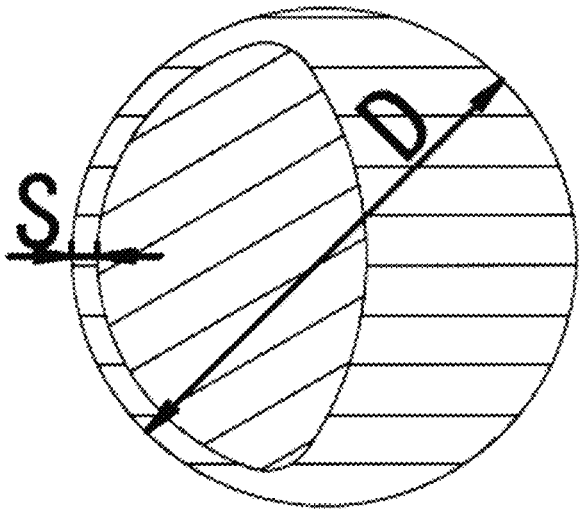
FIG. 3 is a cross-section of an eccentric core-sheath composite fiber and composite fiber, and illustrates the fiber diameter (D) and the minimum thickness (S) in the fiber cross-section.

A more detailed explanation is given using the fiber cross-section shown in FIG. 3. The thickness of the thinnest portion of ingredient B in the core-sheath composite fiber is the minimum thickness S.

It is important that a portion having a thickness up to 1.05 times the minimum thickness S should account for at least one-third entire circumferential length of the composite fiber. This means that ingredient A lies along the contour of the fiber. When compared with a conventional eccentric core-sheath composite fiber having the same areal ratio, the composite fiber has the centers of gravity of the ingredients more apart from each other and forms a finer spiral to develop satisfactory crimpiness.

More preferably, the portion having a thickness up to 1.05 times the minimum thickness S has a peripheral length which is at least two-fifth entire circumferential length of the fiber. Thus, satisfactory stretchability is obtained with no crimpiness unevenness. Furthermore, through the development of crimpiness, the individual fibers come to have an even spiral structure and, hence, sufficient stretchability with no fineness unevenness can be obtained. Consequently, a fabric having a smooth and delicate feeling and a satisfactory appearance free from crinkles, streaks and the like can be obtained.

Figure 4:
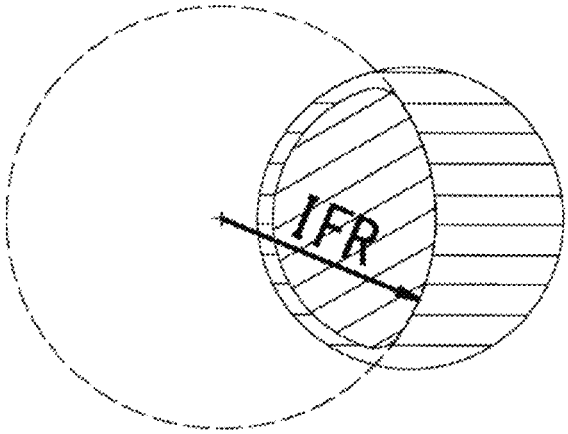
FIG. 4 is a cross-section of an eccentric core-sheath composite fiber, and illustrates IFR (radius of curvature of the interface between ingredient A and ingredient B in the fiber cross-section) in the cross-section.

It is preferable that the fiber cross-section satisfies expression (1), where IFR is the radius of curvature of the interface between ingredient A and ingredient B in the fiber cross-section and R is a value obtained by dividing the fiber diameter D by 2. As shown in FIG. 4, the term "radius of curvature IFR" herein means the radius of a circle (broken line) which is in contact with the curvature of the ingredient A/ingredient B interface where ingredient B, by which ingredient A is covered, has a maximum thickness.

$$(IFR/R) \geq 1 \quad (1)$$

This means that the interface is closer to a straight line. The cross-section has a configuration in which the interface between ingredient A and ingredient B is a curve close to a straight line, which is similar to the configuration of the cross-section of a conventional bonding type crimped fiber. This configuration is preferred because a high degree of crimpiness which has not been obtained with the conventional eccentric core-sheath composite fibers can be developed. More preferably, the value of IFR/R is 1.2 or larger.

The minimum thickness S of ingredient B, by which ingredient A is covered, the fiber diameter D, the radius of curvature IFR of the interface, and the areal ratio are determined in the following manners.

A multifilament yarn including eccentric core-sheath composite fibers is embedded in an embedding material, e.g., an epoxy resin, and a cross-section of the embedded multifilament yarn is photographed with a transmission electron microscope (TEM) to obtain images thereof at such a magnification that ten or more fibers can be observed. In this example, dyeing the cross-section with a metal can render the contrast of the ingredient A/ingredient B bonding part clear by utilizing a difference in dyeing between the polymers. Circumscribed circles of ten fibers which are arbitrarily extracted from each of the images obtained by the photographing and the diameters thereof are measured, and the measured values correspond to the fiber diameter D. When an observation of ten or more fibers is impossible, other fibers may be included to observe ten or more fibers. The term "diameter of a circumscribed circle" herein means the diameter of a complete circle that is circumscribed about a cross-section perpendicular to the fiber axis, which has been extracted from the image obtained by the two-dimensional photographing, at two or more points that are as many as possible.

The image with which the fiber diameter D was determined is used to examine ten or more fibers to measure the minimum thickness of ingredient B, by which ingredient A is covered, and this measured value corresponds to the minimum thickness S. The fiber diameter D, the minimum thickness S, and radius of curvature IFR are each measured in m unit, and the measured values are rounded off to the second decimal place. A simple number average is determined with respect to measured values obtained by examining ten photograph images by the procedure described above and with respect to values of the ratio S/D.

The area of the whole fiber and the areas of ingredient A and ingredient B are determined using an image obtained by the above photographing and using image analysis software "WinROOF 2015," manufactured by Mitani Corp., and then the areal ratio is determined.

The eccentric core-sheath composite fiber preferably has a stretching elongation, as described in JIS L 1013 (2010), 8.11, method C (simplified method), of 20 to 70%. More preferably, the stretching elongation thereof is 40 to 65%. The value thereof indicates the degree of crimpiness. The larger the value thereof, the better the stretchability.

The eccentric core-sheath composite fiber preferably has an Uster unevenness U %, which is an index of fiber thickness unevenness along the longitudinal direction, i.e., the so-called fineness unevenness, of 1.5% or less. When the Uster unevenness thereof is in that range, the fabric can not only be inhibited from having dyeing unevenness but also be inhibited from suffering a decrease in appearance quality due to shrinkage unevenness. Satisfactory fabric appearance quality can hence be obtained. The Uster unevenness thereof is more preferably 1.0% or less.

The eccentric core-sheath composite fiber preferably has a single-filament fineness of 1.0 dtex or less. More preferably, the single-filament fineness thereof is 0.8 dtex or less. Thus, not only the amount of the fiber necessary per unit area can be reduced to improve the lightweight properties of the fabric, but also the fiber has reduced stiffness, making it possible to enhance the softness. Furthermore, this eccentric core-sheath composite fiber gives a fabric having a dense surface morphology. This dense surface morphology, coupled with the fine spiral structure due to the crimpiness of the eccentric core-sheath composite fiber, makes the fabric be a novel stretch material which has an appearance with a smooth and delicate feeling.

For the eccentric core-sheath composite fiber to overcome constraint in fabrics and stably develop crimpiness, important properties are shrinkage stress and the temperature at which the shrinkage stress has a maximum value. The higher the shrinkage stress, the better the development of crimpiness under constraint in fabrics. The higher the temperature at which the shrinkage stress has a maximum value, the easier the handling in finishing steps. Consequently, from the standpoint of enhancing the development of crimpiness, the temperature at which the shrinkage stress has a maximum value is preferably 110° C. or higher, more preferably 130° C. or higher, and the maximum value of the shrinkage stress is preferably 0.15 cN/dtex or higher, more preferably 0.20 cN/dtex or higher.

From the standpoints of process passability in high-order processing and practical use, it is preferable that the eccentric core-sheath composite fiber has toughness not less than a certain value. The strength and elongation of the fiber can be used as indexes of the toughness. The term "strength" herein means a value obtained by determining a load-elongation curve of the fiber under the conditions shown in JIS L1013 (2010) and dividing the load at rupture by an initial fineness. The term "elongation" means a value obtained by dividing the increased length at rupture by the initial sample length. The term "initial fineness" means a value determined by measuring the weight per unit length of the fiber multiple times, calculating a simple average thereof, and calculating the weight per 10,000 m from the average.

The composite fiber preferably has a strength of 0.5 to 10.0 cN/dtex and an elongation of 5 to 700%. In the eccentric core-sheath composite fiber, a practicable upper limit of the strength is 10.0 cN/dtex and a practicable upper limit of the elongation is 700%. When the eccentric core-sheath composite fiber is for use in general clothing applications such as inner or outer wear, it is preferable that the strength thereof is 1.0 to 4.0 cN/dtex and the elongation thereof is 20 to 40%. For use in sports clothing applications and the like which involve severe use environments, it is preferable that the strength of the composite fiber is 3.0 to 5.0 cN/dtex and the elongation thereof is 10 to 40%.

As described above, it is preferable that the strength and elongation of the fiber are regulated, in accordance with intended uses by controlling conditions for production steps.

The mixed-filament yarn is described below in detail together with desirable examples thereof.

The mixed-filament yarn needs to include a filament bundle in which two or more kinds of single filaments differing in cross-sectional configuration are in the state of having been dispersedly intermingled.

The expression "differing in cross-sectional configuration" herein means that single filaments respectively have cross-sections which differ in the kind(s) of the constituent polymer(s) or in the disposition of the polymer(s). An important requirement is that these multiple kinds of single filaments are in the state of having been dispersedly intermingled in the filament bundle.

The expression "state of having been dispersedly intermingled" herein means that when a cross-section of the filament bundle is observed, the multiple kinds of fibers are present without localizing. Namely, the mixed-filament yarn is characterized in that this mixed-filament yarn is free from the unevenness in single-filament proportion which is caused, for example, by ordinary filament mixing performed after spinning and that the multiple kinds of single filaments are in the state of being evenly dispersed in the mixed-filament yarn. This characteristic mixed state of the filaments brings about the following effect: any single filament is adjoined by a single filament having a different composition and these two single filaments come to have a difference in filament length due to thermal shrinkage caused by the heat applied by, for example, heat setting in a fiber formation step or high-order processing step, thereby coming to restrain each other. Because of this, the mixed-filament yarn shows satisfactory bundle characteristics and is effective in diminishing fabric defects such as fluffing or streaks, which have been a problem in background-art techniques.

The state in which two or more kinds of the single filaments have been dispersedly intermingled can be evaluated by examining the proportion of adjacent-filament groups of at least one kind of fibers constituting the mixed-filament yarn. The term "adjacent-filament group" herein means a group of five or more single filaments having the same composition which adjoin each other in a cross-section of the mixed-filament yarn. The term "proportion of adjacent-filament groups" means a value expressed by Ns/N, where Ns is the total number of the single filaments constituting the adjacent-filament groups and N is the total number of the single filaments of the yarn.

Figure 6:
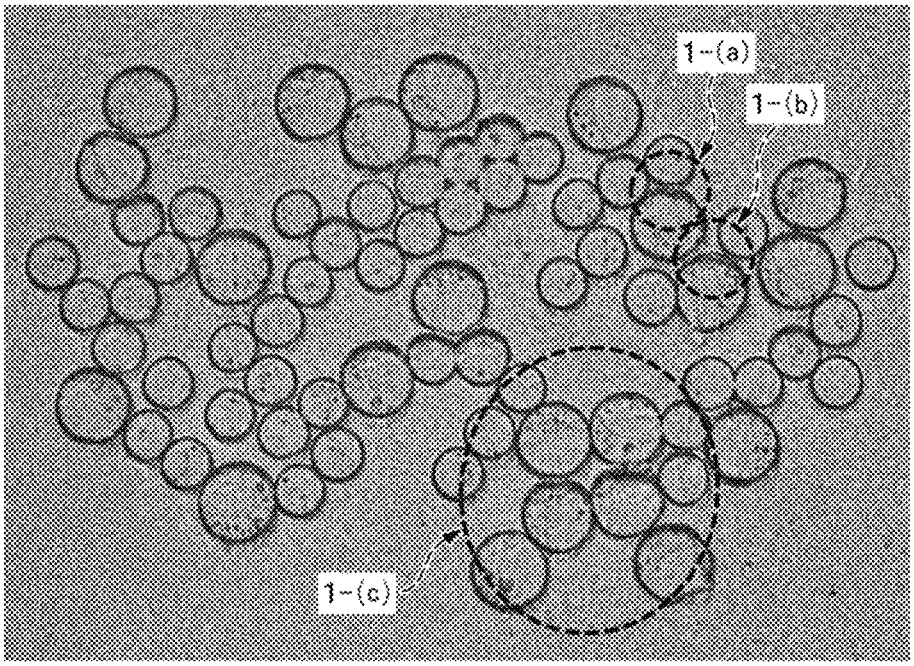
FIG. 6 is a drawing-substitute photograph showing one example of the cross-section of a mixed-filament yarn.

The expression "single filaments adjoin each other" means a situation in which between any single filament and a nearest single filament having the same composition as the single filament, there is no single filament having a different composition, as indicated by 1-(*a*) and 1-(*b*) in FIG. 6. When five or more single filaments are in such state of adjoining each other as indicated by 1-(*c*), this group of single filaments is defined as a group of adjacent filaments. When a plurality of such groups of adjacent filaments are present in the cross-section of the mixed-filament yarn, the total number of the single filaments constituting these groups is the total number Ns of the single filaments constituting adjacent-filament groups.

The proportion of adjacent-filament groups is determined in the following manner.

Namely, a cross-section of a filament bundle which is perpendicular to the fiber axis is photographed with, for example, a digital microscope to obtain an image thereof at such a magnification that the constituent single filaments can be examined. Methods for examining a cross-section of a filament bundle include a method in which either the filament bundle or a sample obtained by processing the filament bundle into a woven or knit fabric is cut along a direction perpendicular to the fiber axis and the cut surface is examined. When a cut surface of the filament bundle is examined, when the filament bundle is embedded in an embedding material, e.g., an epoxy resin, and then cut, a satisfactory cut surface of the filament bundle can be easily obtained since the constituent single filaments are fixed before being cut. Furthermore, when the embedded filament bundle is subjected to dyeing with a metal or the like before or after the cutting, and the interface between the constituent single filaments or the polymers can be made clear because there is a difference in dyeing between the single filaments.

With respect to each of arbitrarily extracted ten portions of a filament bundle, the cut surface of the filament bundle is photographed. On each image, the number of the single filaments constituting adjacent-filament groups is counted. From the results, the proportion of adjacent-filament groups is calculated using (Proportion of adjacent-filament groups) =(number of single filaments constituting adjacent-filament groups)/(total number of single filaments of the kind being examined)×100(%). A simple number average of the results of examining the ten portions was rounded off to the nearest whole number, and the rounded value was taken as the proportion of adjacent-filament groups.

It is preferable that the proportion of adjacent-filament groups for at least one kind of the single filaments is 10 to 50%. When the proportion thereof is within that range, the single filaments having the same composition can be regarded as moderately dispersed in the mixed-filament yarn without localizing. When the constituent single filaments differ in dyeability, the proportion of adjacent-filament groups is more preferably 20 to 40%, because a fabric formed from the mixed-filament yarn has a surface composed not of single filaments of only one of multiple compositions but of moderately mixed single filaments of the multiple compositions. Namely, a fabric having a natural grainy appearance is obtained. Furthermore, when the proportion of adjacent-filament groups in the mixed-filament yarn composed of single filaments differing in dyeability is within that range, the degree of dispersion of the single filaments constituting the mixed-filament yarn can be changed by regulating arrangement of the single filaments. It is hence possible to control the pitch of graininess or the color tone.

The composite fibers as a component of the mixed-filament yarn need to have a cross-sectional configuration including two polymers composited with each other, the two polymers used in combination differing in melt viscosity by 50 Pa·s or more.

Suitable polymers are thermoplastic polymers having fiber-forming properties. Examples thereof include melt-moldable polymers such as poly(ethylene terephthalate) or copolymers thereof, poly(ethylene naphthalate), poly(butylene terephthalate), poly(trimethylene terephthalate), polypropylene, polyolefins, polycarbonates, polyacrylates, polyamides, poly(lactic acid), and thermoplastic polyurethanes. In particular, condensation polymerization polymers represented by polyesters and polyamides are more preferred because of the high melting points thereof. More preferred are polymers having a melting point of 165° C. or higher, because such polymers have satisfactory heat resistance.

These polymers may contain various additives such as an inorganic substance, e.g., titanium oxide, silica, or barium oxide, a colorant, e.g., carbon black or a dye or pigment, a flame retardant, a fluorescent brightener, an antioxidant, or an ultraviolet absorber.

The term "melt viscosity" herein means a value determined by drying a polymer in the form of chips with a vacuum dryer to a moisture content of 200 ppm or less, measuring the melt viscosity of the dried polymer while stepwise changing the strain rate, and determining the viscosity at a temperature equal to the spinning temperature and at a strain rate of 1,216 $s^{-1}$. That the polymers constituting a composite fiber differ in melt viscosity by 50 Pa·s or more means, for example, that in the spinning line, stress is concentrated on the polymer ingredient having a higher melt viscosity. Because of this, in a core-sheath cross-section or a sea-island cross-section, stress is concentrated on the main polymer to bring about excellent mechanical properties. In a bonding type cross-section or the like, a considerable difference is made by the orientation of one of the combined ingredients, making it possible to exhibit preferred crimpiness.

From the standpoint of the development of crimpiness and the like, it is preferable that the difference in melt viscosity between the polymers used in combination is larger. The difference in melt viscosity is preferably 100 Pa·s or larger. Although enlarging the difference in melt viscosity is preferred from that standpoint, an especially preferred range of the difference in melt viscosity between the polymers used in combination is 100 to 400 Pa·s, in view of both property development and controllable differences in longitudinal deformation in the spinning line.

When improvements in touch and puffing sense due to differences in fiber length are aimed at in producing the mixed-filament yarn, it is preferable that composite fibers differing in cross-sectional configuration are used in combination. The composite fibers as a component of the mixed-filament yarn form a three-dimensional spiral structure upon heat treatment. When the composite fibers in a mixed-filament yarn differ in cross-sectional configuration, these composite fibers come to have three-dimensional spiral structures which differ in phase or wave size and thus repel each other, making it possible to obtain a highly bulky yarn. Furthermore, since single filaments having a low crimpiness ratio dispersedly float on the surface because of a difference in fiber length while forming loose crimpiness, a fabric having an excellent feeling is obtained.

The composite fibers contained in the mixed-filament yarn each preferably have a cross-sectional shape of the eccentric core-sheath type in which the core ingredient (ingredient A) is entirely covered by the sheath ingredient (ingredient B).

More preferred combinations of the core ingredient (ingredient A) and the sheath ingredient (ingredient B) are combinations of polyesters because such combinations have satisfactory crimpiness and mechanical properties and have excellent dimensional stability to moisture or temperature fluctuations.

Especially preferred is to use poly(butylene terephthalate) (PBT) as ingredient A, because a fabric having satisfactory crimpiness and good appearance quality is obtained therewith. This is because PBT has a high degree of shrinkage as a property of the polymer and, hence, gives a large difference in shrinkage degree when used in combination with, for example, PET. This combination hence has a high ability to develop crimpiness to give a fabric showing high stretchability. In addition, PBT has extremely high crystallinity and fibers thereof hence show excellent dimensional stability to give a fabric which can be inhibited from suffering streak defects and the like due to unevenness in tension or temperature.

The mixed-filament yarn shows satisfactory bundle characteristics because the multiple kinds of single filaments have been dispersedly intermingled with each other. This can be seen from the number of tangles between single filaments. Specifically, in producing the mixed-filament yarn, when the filaments receive force from a direction perpendicular to the fiber axis in a filament mixing step and each of the filaments is dispersed, the filaments interlace naturally. Meanwhile, a mixed-filament yarn including satisfactorily dispersed single filaments may be obtained by a method in which an interlace nozzle or the like is used in a filament mixing step to interlace the filaments. This method, however, necessitates excessive interlacing for satisfactory dispersing the single filaments.

From such a standpoint, it is important for the mixed-filament yarn that the number of tangles should be 1 to 100/m. When the number of tangles is within that range, the multiple kinds of single filaments in the mixed-filament yarn are in the state of having been dispersedly intermingled and, hence, it is possible to obtain a fabric having a moderately mellow, natural grainy appearance. Furthermore, since the mixed-filament yarn has satisfactory bundle characteristics, this yarn is inhibited from sagging or fluffing and gives fabrics having satisfactory appearance quality.

When the number of tangles is less than 1/m, the single filaments localize within the mixed-filament yarn, and each of the single filaments of is prone to gather respectively. There are hence examples where this mixed-filament yarn suffers splitting or sagging to show impaired process passability in high-order processing. Meanwhile, when the number of tangles is too large, stress is prone to concentrate on the tangles, and this may result in a decrease in rupture strength and fabric defects such as streaks and fluffing. Furthermore, since such a mixed-filament yarn includes too many unopened portions, this yarn may give fabrics having a stiff feeling. From such standpoints, it is important that the number of tangles between single filaments should be 1 to 100/m. Meanwhile, as the number of tangles increases and the single filaments become more dispersed accordingly, the grainy contrast in the fabric undesirably becomes weaker. From this standpoint, a more preferred range of the number of tangles is 1 to 50/m. The number of tangles is determined in accordance with JIS L1013 (2010).

When single-component fibers constituted of a single component are used in the mixed-filament yarn, it is preferred to select a polymer from among the melt-moldable polymers shown above, in accordance with intended uses.

For example, in using a polymer different in dyeability from the composite fibers, a fabric having a grainy appearance according to the difference in color tone is obtained. In using a polymer showing a high degree of shrinkage upon heat treatment such as a copolyester, heat treatment results in a large difference in fiber length between the different kinds of single filaments and the single filaments having a low degree of shrinkage float on the surface, making it possible to obtain a fabric having an excellent feeling. Furthermore, when a polyester containing inorganic particles, e.g., silica that form microscopic recesses and protrusions on the fiber surface through a treatment with an alkali raw material is used, the effect of inhibiting reflection on the fiber surface is obtained, making it possible to improve suitability for deep colors. In using single-component fibers having a Y-shape, the mixed-filament yarn is apt to reflect incident light because of the shape of the fibers to produce a peculiar glossy sense, making it possible to produce a silk-looking fabric.

When the mixed-filament yarn includes one or more kinds of single-component fibers, it is possible to freely select polymers to be used and shapes thereof as described above, and a variety of functions can be imparted to the mixed-filament yarn. This configuration is hence preferred.

In the mixed-filament yarn, the weight proportion of the composite fibers contained therein as a component is preferably 30 to 80% by weight. The term "weight proportion of the composite fibers" herein means a value represented by Tc/Ta, where Tc is the total fineness of the composite fibers of the multiple kinds of fibers constituting the mixed-filament yarn, and Ta is the fineness of the mixed-filament yarn.

The fineness Ta of the composite fibers as a component of the mixed-filament yarn can be determined by producing the composite fibers alone under the same conditions as for the mixed-filament yarn and measuring the fineness thereof using any desired method. Alternatively, the fineness thereof may be calculated in a simplified manner from the following factors used in producing the mixed-filament yarn: the ejection rate for the composite fibers, the ejection rate for the mixed-filament yarn, the spinning speed, and the stretch ratio.

In accordance with such methods of designing the filament bundle configuration, it is possible to control the color tone or other properties of the fabric to be obtained, by changing the weight proportion of the composite fibers. For example, when polyester-based composite fibers are combined with single-component fibers of a cation-dyeable polyester so that the weight proportion of the composite fibers is 50 to 70% by weight, then this mixed-filament yarn gives a fabric which, after being dyed with a cationic dye, has a wool-looking grainy appearance in which the composite fibers, which are lightly dyed, have high visibility. Meanwhile, when the weight proportion of the composite fibers is regulated to a value of 30 to 45% by weight and a fabric is likewise obtained from this mixed-filament yarn and dyed with a cationic dye, then the two kinds of fibers are equal in visibility regarding deep dyeing and light dyeing and a mélange-looked grainy appearance which is mellow and natural is obtained.

The mixed-filament yarn preferably has toughness not less than a certain value, from the standpoints of process passability in high-order processing and practical use. The strength and elongation of the yarn can be used as indexes to the toughness. The term "strength" herein means a value obtained by determining a load-elongation curve of the yarn under the conditions shown in JIS L1013 (2010) and dividing the load at rupture by an initial fineness. The term "elongation" means a value obtained by dividing the increased length at rupture by the initial sample length. The term "initial fineness" means a value determined by measuring the weight per unit length of the yarn multiple times, calculating a simple average thereof, and calculating the weight per 10,000 m from the average.

The mixed-filament yarn preferably has a strength of 0.5 to 10.0 cN/dtex and an elongation of 5 to 700%. In the mixed-filament yarn, a practicable upper limit of the strength is 10.0 cN/dtex and a practicable upper limit of the elongation is 700%. When the mixed-filament yarn is for use in general clothing applications such as inner or outer wear, it is preferable that the strength thereof is 1.0 to 4.0 cN/dtex and the elongation thereof is 20-40%. For use in sports clothing applications and the like which involve severe use environments, it is preferable that the strength of the yarn is 3.0 to 5.0 cN/dtex and the elongation thereof is 10 to 40%.

The composite fibers in the mixed-filament yarn preferably have a crimpiness ratio of 20 to 80%. The crimpiness ratio indicates the degree of crimpiness of the composite fibers. The larger the value of the crimpiness ratio, the better the stretchability. When the crimpiness ratio of the composite fibers in the mixed-filament yarn is 20 to 80%, the mixed-filament yarn also shows satisfactory stretchability. That range is hence preferred. The crimpiness ratio thereof is more preferably in the range of from 40 to 70%.

The crimpiness ratio of the composite fibers can be determined in the following manner.

First, the composite fibers to be used as a component of the mixed-filament yarn are produced alone under the same spinning conditions as for the mixed-filament yarn. A hank of 10 m of the produced composite fibers is taken, and a load of 0.1 g/d is imposed thereon to measure the initial length L0. The load is removed, and the hank with substantially no load imposed thereon is then immersed in boiling water and treated therewith for 15 minutes. The treated fibers are sufficiently dried. Thereafter, a load of 0.1 g/d is reimposed thereon, and the after-treatment length L1 thereof is measured at 30 seconds thereafter. Subsequently, the load is removed, and the length L2 is measured at 2 minutes thereafter. The crimpiness ratio was calculated using the equation:

$$\text{Crimpiness ratio (\%)}=[(L1-L2)/L1]\times 100.$$

For the mixed-filament yarn to overcome constraint in fabrics and stably develop crimpiness, important properties are shrinkage stress and the temperature at which the shrinkage stress has a maximum value. The higher the shrinkage stress, the better the development of crimpiness under constraint in fabrics. The higher the temperature at which the shrinkage stress has a maximum value, the easier the handling in finishing steps. Consequently, from the standpoint of enhancing the development of crimpiness, the temperature at which the shrinkage stress has a maximum value is preferably 110° C. or higher, more preferably 130° C. or higher, and the maximum value of the shrinkage stress is preferably 0.15 cN/dtex or higher, more preferably 0.20 cN/dtex or higher.

It is preferable that the strength and elongation of the mixed-filament yarn are regulated in accordance with intended uses as shown above, by controlling conditions for production steps.

The mixed-filament yarn can be formed into various intermediates, including a yarn roll package, tow, cut fibers, wadding, fiber balls, cord, pile, woven or knit fabric, or nonwoven fabric, and then into various fibrous products. Specifically, the mixed-filament yarn is usable in or as fibrous products which include general garments, e.g., jackets, skirts, pants, and underwear, sportswear, clothing materials, interior products, e.g., carpets, sofas, and curtains, and interior parts for vehicles, e.g., automotive seats, and which further include ones for living applications, e.g., cosmetics, cosmetic masks, wiping cloths, and health care goods, ones for environmental/industrial applications, e.g., polishing cloths, filters, products for removing harmful substances, and separators for batteries, and ones for medical applications, e.g., sutures, scaffolds, artificial blood vessels, and blood filters.

Preferred processes of producing an eccentric core-sheath composite fiber are described next.

The eccentric core-sheath composite fiber be produced by any of processes including: a two-step process in which ejected polymers are temporarily wound up as unstretched filaments and thereafter stretched; a direct spinning/stretching process in which spinning and stretching steps are consecutively performed; and a high-speed fiber formation process. The range of spinning speed in the high-speed fiber formation process is not particularly limited and the process may hence include steps in which the ejected filaments are wound up as semi-stretched filaments and thereafter stretched. Fiber processing such as false twisting may be conducted according to need.

When an eccentric core-sheath composite fiber is produced by the two-step process, not only hot-roll/hot-roll stretching or stretching with hot pins but also any of all common stretching methods can be used. Stretching may be conducted together with interlacing or false twisting, in accordance with intended uses. From the standpoint of inhibiting fluffing or abnormal compositing, e.g., separation between the two ingredients, it is preferred to conduct stretching to yield stretched filaments having a residual elongation of 25 to 50%.

When the filaments in a stretched state are subjected to heat setting and cooled, while maintaining the strained state, to or below the glass transition temperatures to fix the structures of the molecular chains, the composite fiber thus obtained can have heightened shrinkage stress and this method is effective in improving the feeling of the fabric. Specifically, it is preferable that the filaments in a stretched state of about 0.3 to 3.0% are passed through cold rolls because high shrinkage stress is obtained. Fiber formation and winding are conducted while keeping the polymer to be shrunk (e.g., ingredient A) under stress strain to develop crimpiness, hence there have been instances where delayed shrinkage occurs because of a viscoelastic behavior during the period from the winding to fabric formation, resulting in streaks in the fabric.

Meanwhile, since one ingredient is entirely covered by the other ingredient, not only the delayed shrinkage can be inhibited but also the configuration can contribute to obtaining an even fabric. In addition, high-molecular-weight polymers, high-elasticity polymers, and the like that have been unusable as high-shrinkage ingredients can be used, making it possible to obtain novel core-sheath composite fibers.

The spinning temperature is preferably set at a temperature higher by 20 to 50° C. than the melting points of the polymers. By setting the spinning temperature at a temperature higher by at least 20° C. than the melting points of the polymers, the polymers can be prevented from solidifying in the pipelines of the spinning machine to clog the pipelines. By setting the spinning temperature at a higher temperature which is up to the temperature higher by 50° C. than the melting points, the polymers can be inhibited from being excessively deteriorated by heat. That range is hence preferred.

It is preferred to obtain the eccentric core-sheath composite fiber by melt spinning. The spinneret may have any of common internal structures so long as the spinneret renders stable spinning with respect to quality and operation possible. In particular, the distribution plate type spinnerets shown in JP-A-2011-174215, JP-A-2011-208313, and JP-A-2012-136804 are suitable for obtaining desired cross-sectional shapes.

It is important for the eccentric core-sheath composite fiber that ingredient A should be covered entirely by ingredient B, as shown in FIG. 2. This cross-section is effective in inhibiting the ejected-filament bending (kneeing phenomenon) which occurs due to a difference in flow rate between the two polymers during ejection from the spinneret.

In the conventional structure formed by mere bonding (bimetallic structure), the two polymers have a difference in stress balance when being thinned on the spinning line after ejection from the spinneret, resulting in uneven longitudinal deformation. There have been instances where the uneven deformation causes fineness unevenness to increase the U %. This tendency is considerably strong when polymers having a large difference in viscosity are used in combination or when the fineness is enhanced, for example, by reducing the ejection rate. However, since one polymer is covered by the other, a stress balance is maintained within the fiber cross-section and fineness unevenness can hence be inhibited from occurring.

We discovered that when a high-molecular-weight polymer is used as ingredient A and a low-molecular weight polymer is used as ingredient B, excellent stability in high-speed fiber formation is attained because ingredient A is covered entirely by ingredient B. This is an effect brought about by the disposition of the low-molecular weight polymer on the outer side, which has rendered the high-molecular-weight polymer apt to conform to longitudinal deformations after ejection from the spinneret.

Thus, freedom of polymer selection for improving added values, other than stretchability improvement, or for improving fiber formation stability is greatly heightened even in high-fineness fibers. The configuration further contributes to an improvement in production efficiency.

As described above, the cross-sectional shape is effective in inhibiting the fiber from having fineness unevenness.

In this operation, the spinning draft ratio is preferably 300 or less, because unevenness in physical property among the filaments is diminished and even fibers are obtained. The number of filaments can be suitably set depending on a spinneret size. However, it is preferred to maintain the distance between filament ejection holes at 10 mm or larger, because the filaments can be smoothly cooled and solidified and it is easy to obtain even fibers.

In producing the eccentric core-sheath composite fiber, the spinning draft ratio, which is represented by the following equation, is preferably 50 to 300:

$$\text{Spinning draft ratio} = Vs/V0$$

Vs: spinning speed (m/min)

V0: ejection-line speed (m/min).

By regulating the spinning draft ratio to 50 or higher, the polymer streams ejected from the spinneret holes can be prevented from staying beneath the spinneret for a prolonged period and from thereby fouling the spinneret surface. Hence, stable fiber formation is attained. Meanwhile, by regulating the spinning draft ratio to 300 or less, filament breakage due to excessive spinning tension can be inhibited and eccentric core-sheath composite fibers can be obtained with stable fiber formation. That range is hence preferred. The spinning draft ratio is more preferably 80 to 250.

In producing the eccentric core-sheath composite fiber, the spinning tension is preferably 0.02 to 0.15 dN/dtex. By regulating the spinning tension to 0.02 cN/dtex or higher, the single filaments are prevented from suffering mutual interference due to filament oscillation during spinning and are not reversely wound on a take-up roller which is the first roller. The filaments can hence run stably. Meanwhile, by regulating the spinning tension to 0.15 cN/dtex or less, eccentric core-sheath composite fibers are obtained with stable fiber formation. That range is hence preferred. A more preferred range of the spinning tension is 0.07 to 0.1 cN/dtex.

In producing the eccentric core-sheath composite fiber while attaining stable operation and quality, it is preferred to strictly control the cooling and solidification of the ejected polymers. When the polymer ejection rate is reduced with enhancement of fineness, the zone where the thinning of the polymers and the cooling and solidification thereof occur approaches the spinneret (shifts upstream). Because of this, the fibers obtainable with the cooling methods supposed to be used in prior-art techniques are limited to ones having considerable longitudinal-direction unevenness. In addition, an air stream accompanying the solidified fibers is enhanced to increase the spinning tension. Techniques for diminishing these are hence necessary. A preferred method of inhibiting the spinning tension from increasing is to set a cooling initiation point at a position 20 mm to 120 mm apart from the spinneret surface. By regulating the distance between the cooling initiation point and the spinneret surface to 20 mm or larger, the spinneret can be inhibited from suffering a decrease in surface temperature due to cooling air, making it possible to avoid various problems including low-temperature filaments, spinneret hole clogging, abnormal compositing, and ejection unevenness. Such distances are hence preferred. Meanwhile, by regulating the distance between the cooling initiation point and the spinneret surface to 120 mm or less, eccentric core-sheath composite fibers of high quality which have little longitudinal-direction unevenness can be obtained. Such distances are hence preferred. A more preferred range of the distance between the cooling initiation point and the spinneret surface is 25 mm to 100 mm.

To inhibit the spinneret surface temperature from being lowered by the cooling air, the temperature of the cooling air may be controlled or a heater may be disposed in the vicinity of the spinneret, according to need.

The distance from the spinneret ejection surface to an oiling position is preferably 1,300 mm or shorter. By regulating the distance from the spinneret ejection surface to the oiling position to 1,300 mm or shorter, the width over which the filaments oscillate due to the cooling air can be reduced and the longitudinal-direction fiber unevenness can be mitigated. In addition, the air stream accompanying the filaments until the filaments have been collected can be diminished, thereby reducing the spinning tension and making it easy to attain stable fiber formation with little fluffing and few filament breakages. Such distances are hence preferred. A more preferred range of the oiling position in the spinning step for producing the eccentric core-sheath composite fiber is up to 1,200 mm.

Next, preferred processes of producing a mixed-filament yarn are described.

It is preferred to use a spinning/filament mixing method to obtain the mixed-filament yarn. The term "spinning/filament mixing method" herein means a production method in which multiple kinds of single filaments are ejected from the same spinneret and wound up simultaneously.

In the spinning/filament mixing method, the multiple kinds of single filaments are simultaneously collected during winding. The individual single filaments are hence apt to be dispersed in the mixed-filament yarn, and this method of producing the desired mixed-filament yarn is preferred. In the spinning/filament mixing method, the degree of dispersion in the mixed-filament yarn can be changed by modifying the spinneret by changing the number and arrangement of ejection holes that correspond to each of the single filaments. For example, when development of graininess is desired, the pitch of changes in color depth and the overall color tone can be controlled in accordance with the degree of dispersion of single filaments.

Meanwhile, it is not impossible to obtain a mixed-filament yarn by an after-mixing method in which different kinds of filaments are separately spun and thereafter mixed with each other in another step. However, this production method has a drawback in that the filaments are respectively oiled to be temporarily collected, and are slightly twisted, for example, when the temporarily wound filaments are unreeled from the pims. Because of this, mixing these filaments by common means has limitations in evenly dispersing one kind of the single filaments in the mixed-filament yarn. Special processing or the like is hence necessary. In view of this, suitable for obtaining the mixed-filament yarn is the spinning/filament mixing method in which two or more kinds of single filaments are mixed in a spinning step.

The spinning temperature is preferably a temperature at which mainly the high-melting-point or high-viscosity polymer, of the polymers to be used for producing the mixed-filament yarn, shows flowability. Although the temperature at which the polymer shows flowability varies depending on the molecular weight, the melting point of the polymer is usable as a reference. The spinning temperature may be set at a temperature higher than the melting point by up to 60° C. When the spinning temperature is higher than the melting point by up to 60° C., the polymers are not pyrolyzed in the spinning head or spinning pack and are hence inhibited from decreasing in molecular weight. Such spinning temperatures are hence preferred.

It is preferable in the mixed-filament yarn that the composite fibers, in particular, are regulated by accurately controlling the wall thickness of the sheath and the peripheral length of the thin-wall portion. Suitable is a method which uses any of the distribution plates shown in JP-A-2011-174215, JP-A-2011-208313, and JP-A-2012-136804. In producing composite fibers having an eccentric core-sheath cross-section using any of common composite spinnerets, there are often examples where it is exceedingly difficult to accurately control the position of the center of gravity of the core and the wall thickness of the sheath. For example, when the sheath has too small a wall thickness and the core ingredient is exposed, the exposed portions are causative of whitening and fluffing in the fabric which occur upon friction or impacts. Conversely, when the sheath has too large a wall thickness, there may be a problem in that the composite fibers are reduced in the development of crimpiness and hence have reduced stretchability.

In the method in which such distribution plates are used, it is possible to control the cross-sectional configuration of the single fibers by regulating the disposition of distribution holes in the final distribution plate disposed most downstream, among the multiple distribution plates. In single-component fibers, holes having the same diameter may be formed in all the distribution plates.

Figure 7:
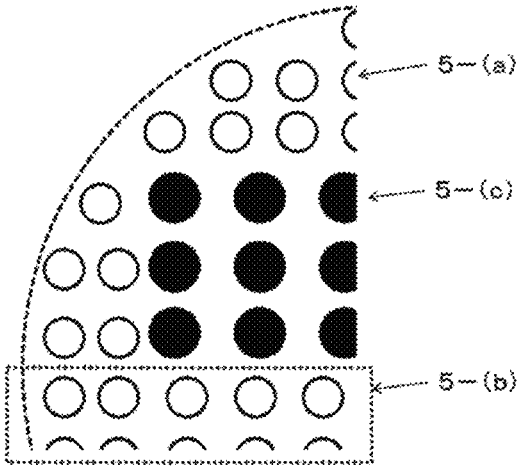
FIG. 7 shows an example of the disposition of distribution holes in a final distribution plate.

In a composite fiber, the cross-sectional configuration can be controlled by changing the arrangement of distribution holes for a polymer (ingredient A) serving as a core ingredient and distribution holes for a polymer (ingredient B) serving as a sheath ingredient. Specifically, as shown in FIG. 7, distribution holes 5-(*a*) and 5-(*b*) for a polymer (ingredient B) serving as a sheath ingredient are disposed to surround distribution holes 5-(*c*) for a polymer (ingredient A) serving as a core ingredient. This arrangement is preferred because an eccentric core-sheath composite cross-section necessary can be formed therewith.

The number of the distribution holes 5-(*a*) for the polymer (ingredient B) for forming a thin-wall portion is preferably 6 or larger, from the standpoints of entirely covering the core ingredient and making the thickness of the thin-wall portion even. The value of S/D in the cross-section of the composite fiber or the length of the minimum-thickness portion therein can be controlled by arranging the distribution holes to change the number of the distribution holes 5-(*a*) for forming a thin-wall portion or to change the polymer ejection rate per distribution hole. Consequently, when a plurality of distribution hole groups respectively giving composite-fiber cross-sections differing in sheath-wall thickness or in deviation of the gravitational centers are disposed in the same distribution plate, then eccentric core-sheath composite fibers differing in cross-sectional configuration, i.e., in the crimpiness ratio, can be produced with the same spinneret.

The polymer streams having a cross-section thus formed with the distribution plate are narrowed and ejected from an ejection hole of the spinneret. In this operation, the ejection hole is used for the purposes of measuring the flow rate, i.e., ejection rate, of the composite polymer flow again and controlling the draft on the spinning line (=take-up speed/ejection-line speed). It is preferred to determine the hole diameter and the hole length while taking account of the viscosity of each polymer and the ejection rate. In producing the mixed-filament yarn, an ejection hole diameter and an L/D (election hole length/ejection hole diameter) can be 0.1 to 2.0 mm and 0.1 to 5.0, respectively.

In the composite fibers as a component of the mixed-filament yarn, as described above, it is preferable that ingredient A is entirely covered by ingredient B as shown in FIG. 2. By configuring this cross-section, the ejected-filament bending (kneeing phenomenon) that occurs due to a difference in flow rate between the two polymers during ejection from the spinneret can be inhibited. Namely, the presence of the sheath ingredient produces force in the direction opposite to the direction in which the polymer stream bends and, as a result, the force produced in a direction perpendicular to the spinning line by a difference in flow rate between the two polymers at the time of ejection from the spinneret can be diminished.

From the standpoint of inhibiting the ejected-filament bending, the difference in melt viscosity between the polymers to be used for the composite fibers is important. Two molten polymers to constitute a composite fiber, when being narrowed, change in cross-sectional area in the cross-section perpendicular to the direction of polymer flow to become equal in pressure loss. As a result, a difference in flow rate arises and the two polymers are ejected to have respective gravitational centers at different positions, thereby causing ejected-filament bending.

Namely, the polymer having a high melt viscosity has an increased cross-sectional area and hence has a reduced flow rate, whereas the polymer having a low melt viscosity has a reduced cross-sectional area and hence has an increased flow rate. Because of this, by reducing the difference in melt viscosity between the polymers to be used, the polymers are made to have a reduced flow rate difference therebetween and the ejected-filament bending can be reduced. In this respect, it is preferable that polymers having a smaller difference in melt viscosity are used in combination. However, in the composite fiber, it is preferable that polymers having a larger difference in melt viscosity are used in combination, in view of the development of crimpiness and the like. In view of these, an especially preferred range of the difference in melt viscosity between the polymers to be used in combination is 100 to 400 Pa·s.

Since the ejected-filament bending is thus reduced, the filaments can be inhibited from interfering with each other on the spinning line. It is hence possible to increase the density of ejection holes in the surface of the spinneret, that is, to increase the number of ejection holes per spinneret. Thus, a higher degree due to formation of a larger number of filaments and an improvement in production efficiency can be attained.

In the spinning/filament mixing method, the disposition of ejection holes for each kind of single filaments can be designed highly freely. For example, graininess can be controlled by changing hole arrangement. When single filaments of multiple kinds differing in dyeability are disposed alternately along a cross-sectional direction in the so-called zigzag lattice arrangement, each kind of the single filaments is satisfactorily dispersed in the mixed-filament yarn and the filaments differing in dyeability hence evenly appear in the surface of the mixed-filament yarn. This mixed-filament yarn can bring about a moderately mellow melange-looking grainy appearance. Meanwhile, when single filaments of multiple kinds differing in dyeability are disposed separately from each other in the so-called grouping arrangement, some of the single filaments sometimes remain as small groups. This mixed-filament yarn can give a fabric in which the portions where single filaments are present as such groups have high visibility and which hence has a rough grainy appearance. Since disposition of ejection holes for each kind of single filaments in the spinneret surface can be designed highly freely as shown above, it is preferred to determine the number and disposition of holes for each kind of single filaments in accordance with the desired graininess.

Although the ejected polymer streams are bent by the cooling air during cooling, the degree of the bending varies depending on the melt viscosities, kinds of the polymers, and the fineness of the single filaments. In the spinning/filament mixing method, there are hence examples where mutual interference occurs due to a difference in bending among single filaments and this results in enhanced fiber unevenness and single-filament sagging. From this standpoint, when there is the possibility of interference among single filaments during cooling, it is preferred to employ a hole arrangement which does not result in interference, while taking account of single-filament bending.

With respect to the ejection rate in spinning the mixed-filament yarn, a range thereof capable of stable ejection may be 0.1 to 20.0 g/min per ejection hole. In this example, it is preferred to take account of a pressure loss in the ejection holes which is capable of ensuring ejection stability. It is preferable that an ejection rate within that range is determined from the melt viscosities of the polymers and the relationship between the diameter and length of each ejection hole, while aiming at a pressure loss of 0.1 to 40 MPa.

It is also preferred to determine the ejection rate in accordance with the desired fineness while taking account of winding-up conditions, stretch ratio and the like. In producing the mixed-filament yarn using the spinning/filament mixing method, the multiple kinds of single filaments have a difference in spinning stress when being collected and thereby have improved dispersibility. In this example, single-filament fineness also is an important element. Specifically, single filaments having a small value of fineness are apt to come among the other single filaments, and it is preferable that the mixed-filament yarn includes single filaments having a small value of fineness from the standpoint of enhancing the dispersion of single filaments.

However, when the constituent fibers include single filaments having an exceedingly small value of fineness, these single filaments have considerably increased spinning stress and, hence, a large difference in the degree of bending arises among the single filaments on the spinning line. Consequently, there are examples where mutual interference occurs, resulting in enhanced fiber unevenness and single-filament sagging. Furthermore, in the spinning/filament mixing method, the winding tension varies depending on the single filaments being wound and this may result in sagging. From this standpoint, the fineness ratio of the constituent single filaments is preferably 1.0 to 5.0.

The term "fineness ratio of single filaments" means a value represented by Tmax/Tmin, where Tmax and Tmin are the maximum and the minimum, respectively, of the fineness values of the single filaments constituting the mixed-filament yarn. When the fineness ratio of the single filaments is within that range, the filaments show reduced interference during cooling and can have a reduced difference in winding tension. Consequently, the mixed-filament yarn can be stably produced.

The polymer streams thus ejected are cooled and solidified by cooling air having constant wind speed and temperature. The wind speed and temperature of the cooling air may be determined while taking account of the efficiency of cooling the filaments and stabilization of the atmosphere around the solidification point. In the spinning/filament mixing, however, the single filaments for constituting the mixed-filament yarn have a large difference in the degree of bending on the spinning line depending on the kinds thereof. Because of this, when there is the possibility of interference among single filaments, in determining a cooling method, it is preferred to take account of the polymer configuration of each kind of single filaments, spinning temperature, hole arrangement and the like to prevent interference.

For example, when the hole arrangement is a grouping arrangement, it is desirable to blow cooling air from such a direction that windward single filaments do not overlap any leeward single filaments. Meanwhile, when one kind of single filaments is disposed to surround a group of another kind of single filaments in the core-sheath arrangement, the filaments may interfere with one another when cooling air is blown thereagainst from a direction perpendicular to the filaments. It is hence preferred to blow cooling air from outside the filaments toward the inside thereof.

The filaments thus cooled and solidified are simultaneously collected and oiled.

Each of the single filaments becomes dispersed in the mixed-filament yarn when being collected. Consequently, from the standpoint of obtaining a mixed-filament yarn in which the single filaments are satisfactorily dispersed such as the mixed-filament yarn, it is preferred to collect all the filaments simultaneously. With respect to the oil to be used, an oiling method, the deposition amount and kind of the oil may be determined while taking account of the winding conditions, high-order processing, process passability and the like. The filaments may be slightly interlaced with, for example, an interlace nozzle to enhance even adhesion of the oil, to such a degree that this does not defeats the desired effect.

The polymer streams that have thus been cooled and solidified and then oiled are taken up by a roller having a given peripheral speed, thereby giving a mixed-filament yarn. A take-up speed may be determined from the ejection rate, the desired fiber diameter, high-order processing and the like. However, a take-up speed of 100 to 7,000 m/min is preferred from the standpoint of stably producing the mixed-filament yarn.

This mixed-filament yarn may be temporarily wound up and thereafter stretched or may be successively stretched without being temporarily wound up, from the standpoint of highly orienting the filaments to improve the mechanical properties.

Conditions for this stretching may be, for example, as follows. A stretching machine including at least a pair of rollers is used. Typically, when the fibers are constituted of polymers showing thermoplasticity that renders the polymers melt-spinnable, the fibers are stretched, without especially requiring force, in the fiber axis direction by a peripheral-speed ratio between a first roller, which has a set temperature not lower than the glass transition temperature and not higher than the melting point, and a second roller, which has a temperature corresponding to the crystallization temperature, heat-set therewith, and then wound up. In polymers showing no glass transition, the composite fibers are subjected to a dynamic viscoelasticity examination (tan δ), and a temperature not lower than the temperature corresponding to the obtained higher-temperature-side tan δ peak may be selected as a preheating temperature.

Since the mixed-filament yarn is configured of single filaments of multiple kinds differing in cross-sectional configuration, a difference in tension arises among the single fibers when the single fibers are wound up in the stretching step. When the difference is large, some of the single filaments become loose on the surface and this may result in single-filament breakage or fluffing to impair the process passability. It is hence preferred to regulate the draft on the spinning line (=take-up speed/ejection-line speed) to make the single filaments receive even winding tension. Specifically, it is preferred to regulate the ejection hole diameter and the spinning speed so that all the single filaments for constituting a mixed-filament yarn have substantially the same elongation at rupture before being stretched.

Furthermore, to give a relaxing treatment in the stretching step to make the single filaments receive even winding tension is an effective means of inhibiting the loosening and is preferred. For example, the speed of a roller next to the heat-setting roller is set at a value lower than the speed of the heat-setting roller to give a relaxing treatment. As a result, the single filaments for constituting a mixed-filament yarn are heat-set to have even tension. This treatment is hence effective in inhibiting the loosening during winding-up. When the single filaments are heat-set in an excessively relaxed state, the structure of the molecular chains is fixed in a loosened state, and this may result in a decrease in shrinkage stress to impair the stretchability of the fabric. It is therefore preferred to select a relaxation degree capable of ensuring sufficient shrinkage stress. Also effective in inhibiting the loosening during winding-up is to set the speed of the winder at a value lower than the speed of the roller located just before the winder and wind up the single filaments while keeping the filaments relaxed. In this example, the higher the relaxing degree, the more the winding tension is made even and the more the loosening can be inhibited. However, an excessively increased relaxing degree may result in reverse winding on the roll to impair the process passability. It is hence preferable that the relaxing degree is within 10%.

When a further improvement in the stretchability of the mixed-filament yarn is aimed at, it is preferred to conduct false twisting to impart crimpiness. When draw texturing is to be conducted in high-order processing, it is preferred to use partially oriented filaments as unstretched filaments from the standpoints of preventing fusion bonding within the heater, increasing the processing speed, and inhibiting fluffing due to reduced stretching tension. Since partially oriented filaments have an oriented amorphous component and a crystal precursor therein, these filaments have a high crystallization rate and are effective not only in preventing fusion bonding within the heater but also in heightening the processing speed by shortening the heat treatment period. It is hence preferable that the single filaments constituting a mixed-filament yarn are examined for the degree of shrinkage in warm water and birefringence to select a take-up speed to obtain partially oriented filaments. For example, in polyesters, our investigations revealed that when a take-up speed of 2,000 to 3,500 m/min is used, a textured yarn having excellent stretchability and, despite this, bringing about satisfactory graininess can be produced, although the take-up speed slightly varies depending on the single-filament fineness and the kinds and viscosities of the polymers.

When a fabric having a more conspicuous grainy appearance is desired, uneven stretching may be conducted. By unevenly stretching a mixed-filament yarn which has been wound up, not only a difference in dyeability among the single filaments but also a difference in dyeability between the stretched portions and the unstretched portions arise. Hence, differences in color depth are further enhanced and conspicuous graininess can be expressed. Furthermore, since a difference in color depth can be imparted along the fiber direction in the mixed-filament yarn, it is possible to change the fiber-direction pitch of changes in color depth in the graininess. When a mixed-filament yarn is subjected to uneven stretching, it is preferable that unstretched filaments are partially oriented filaments, because the mechanical properties and heat resistance of the unstretched portions can be ensured. The stretch ratio is preferably 0.9 to 0.99 times of the natural stretch ratio of the unstretched filaments, because a natural and clear grainy appearance can be obtained thereby. It is preferred to determine the ratio in accordance with desired graininess.

The mixed-filament yarn may be twisted in accordance with applications. For example, when about 1,000 twists/meter are given to the mixed-filament yarn, the pitch in graininess can be shortened, making it possible to express a melange-looking appearance with mellower differences in color depth.

In all the steps described above, it is preferred to interlace the filaments using, for example, an interlace nozzle.

Although processes of producing the mixed-filament yarn were explained above on the basis of the common melt spinning method, it is a matter of course that the mixed-filament yarn can be produced also by the melt-blowing method and the spunbonding method. Furthermore, the mixed-filament yarn can be produced also by solution spinning methods including a wet method and a dry/wet method or the like.

EXAMPLES

The eccentric core-sheath composite fiber is explained below in detail by reference to Examples. In the Examples and Comparative Examples, the following properties were evaluated.

(1) Melt Viscosity of Polymer

A polymer in the form of chips was dried with a vacuum dryer to a moisture content of 200 ppm or less, and the melt viscosity thereof was measured with Capirograph 1B, manufactured by Toyo Seiki Ltd., while stepwise changing the strain rate. The measurement was made at a temperature equal to the spinning temperature. Shown in the Examples and Comparative Examples are melt viscosity values measured at 1,216 $s^{-1}$. The period from sample introduction into a heating oven to initiation of the measurement was set at 5 minutes, and the measurement was made in a nitrogen atmosphere.

(2) Fineness

A counter reel having a peripheral length of 1.0 m was used to form a 100-revolution hank, and the fineness was determined using the following equation:

$$\text{Fineness (dtex)}=(\text{weight of 100-revolution hank (g)})\times 100.$$

(3) Strength, Elongation at Rupture, and Toughness of Fiber

A sample was examined with a tensile tester ("TENSILON" UCT-100, manufactured by Orientec Ltd.) under the constant-speed stretching conditions shown in JIS L1013 (2010) 8.5.1, normal-state test. The holding interval was 20 cm, the stretching speed was 20 cm/min, and the test was conducted ten times. The elongation at rupture was determined from the point on the S-S curve at which a maximum strength was observed. The toughness was determined using the following equation:

$$\text{Toughness}=(\text{strength (cN/dtex)})\times\sqrt{(\text{elongation (\%)})}.$$

(4) U % of Eccentric Core-Sheath Composite Fiber

Using an evenness tester (UT-4) manufactured by Zellweger, U % (H) was determined under the conditions of a fiber supply speed of 200 m/min, a twister rotation speed of 20,000 rpm, and a measurement length of 200 m.

(5) Stretching Elongation (Stretchability)

Stretching elongation was determined in accordance with JIS L1013 (2010) 8.11, method C (simplified method).

(6) Shrinkage Stress

A measurement was made with thermal-stress tester KE-2S, manufactured by Intec Ltd. (former name: Engineering Ltd.) at a heating rate of 150° C./min. The sample was 0.1 m by two loops, and the initial tension was (fineness (dtex))×0.03 cN. The maximum-value temperature (° C.) is the temperature at which the shrinkage stress had a maximum value.

(7) Fiber Formation Stability

A fiber was formed in each Example and fiber formation stability was evaluated in three grades on the basis of the number of fiber breakages per 10,000,000 m:

Excellent (A): less than 0.8 times per 10,000,000 m

Good (B): 0.8 times or more and less than 2.0 times per 10,000,000 m

Poor (C): 2.0 times or more per 10,000,000 m.

(8) Evaluation of Fabric of Eccentric Core-Sheath Composite Fiber

A knitted fabric sample having a length of 5 cm was produced on a knitting machine of 3.5 inches by 280 knitting needles and dyed under the following dyeing conditions:

Dye: Terasil Navy Blue (manufactured by Ciba-Geigy Ltd.) 0.4%

Auxiliary: Tetrosin PEC (manufactured by Seiken Kako) 5.0%

Dispersant: Sunsolt #1200 (manufactured by Nikka Chemical) 1.0%

Dyeing conditions: 50° C.×20 min→98° C.×20 min.

The fabric was relatively evaluated for surface evenness (in particular, crinkles and streaks), feeling (in particular, smoothness and softness), and evenness in dyeing by five skilled examiners on the basis of the feel. Each item was rated in four grades: overall extremely good (4 points), good (3 points), not very good (2 points), and poor (1 point). The points were summed up (maximum: 12 points), and an average of the sums for the respective examiners was used to evaluate the fabric as follows:

Excellent (A): 10 points or more

Good (B): 8 points or more but less than 10 points

Poor (C): less than 8 points.

(9) Evaluation of Wear Resistance

Ten fabric samples cut into a size with a diameter of 10 cm were prepared and divided into five sets each composed of two. Each sample was set on a holder for evaluation. The sample on one side was fully wetted with distilled water, and the two samples were then stacked together. While applying a pressing pressure of 7.4 N, the two samples were rubbed against each other. The samples were examined for single-fiber fluffing (fibrillation) and whitening with microscope VHX-2000, manufactured by Keyence Corp., at a magnification of 50 times. In this test, the sample surfaces were examined for any change through the abrasion treatment and were evaluated for both fibrillation and whitening to rate the wear resistance in three grades. When the whole sample surfaces suffered fibrillation or whitening through the treatment was rated as unacceptable (indicated by "C"), when fibrillation or whitening was observed in some of the surfaces was rated as acceptable (indicated by "B"), and when neither fibrillation nor whitening was observed was rated as good (indicated by "A").

(10) Proportion of Adjacent-Filament Groups

Cross-sections of a filament bundle which were perpendicular to the fiber axis were photographed with a digital microscope (VHX-2000, manufactured by Keyence Corp.) at a magnification capable of examination of the constituent single filaments, and ten or more images thereof were obtained. Ten portions were arbitrarily extracted from each image, and the number of the single filaments constituting each adjacent-filament group was counted. From the results of the examination, the proportion of adjacent-filament groups was calculated using (Proportion of adjacent-filament groups)=(number of single filaments constituting adjacent-filament groups)/(total number of single filaments of the kind being examined)×100(%). A simple number average of the results of examining the ten portions was rounded off to the nearest whole number, and the rounded value was taken as the proportion of adjacent-filament groups in the filament bundle being evaluated.

(11) Number of Tangles

An entanglement tester (Type R2072), manufactured by Rothschild (Swiss), was used to determine the number of tangles in the following manner.

A yarn was caused to run at a constant speed of 5 m/min while applying an initial tension of 10 g, with a needle kept piercing the yarn, and the length (open-portion length) in which the tension in each tangle point reached a given value (trip level) of 15.5 cN was measured thirty times. An average for the thirty measurements was obtained. From the average length (average open-portion length (mm)), the degree of entanglement (CF value)/m of the yarn was determined using the following equation. The calculated value was rounded off to the first decimal place.

Degree of entanglement (CF value)=1,000/(average open-portion length)

(12) Evaluation of Fabric of Mixed-Filament Yarn (Stretchability, Feeling, Graininess)

Using a mixed-filament yarn as weft and a 56-dtex 18-filament polyester fiber as warp, a woven fabric of a ⅓ twill weave having a weft density of 113 yarns per inch was produced. The woven fabric was scoured at 80° C. for 20 minutes and dyed under the following dyeing conditions:

| | |
|---|---|
| Dye: NICHILON BLUE (Nissei Kasei) | 3.0% owf |
| Auxiliary: Ultra N-2 (Mitejima Chemical) | 0.5 g/L |
| Dispersant: RAP-250 (Meisei Chemical) | 0.5 g/L |

Dyeing conditions: 50° C. × 20 min → 100° C. × 30 min.

The woven fabric sample thus produced was evaluated for fabric stretchability (rated as excellent, good, or poor) and feeling (in particular, puffiness and surface touch; rated as excellent, good, or poor) by ten skilled examiners on the basis of the feel. The sample was further evaluated visually for fabric graininess by the examiners and rated in the following four grades:

Excellent: mellow graininess

Good: slightly mellow graininess

Fair: slightly rough graininess

Poor: rough graininess.

Example 1

Poly(butylene terephthalate) (PBT1; melt viscosity: 160 Pa·s) was used as ingredient A, and poly(ethylene terephthalate) (PET1; melt viscosity: 140 Pa·s) was used as ingredient B. The polymer of ingredient A and the polymer of ingredient B were melted with separate extruders respectively at 270° C. and 280° C. and then metered with pumps to a spinneret while maintaining the temperatures. The spinning temperature was set at 290° C., which was higher by 30° C. than the melting point of the sea ingredient, which was the polymer higher in melting point between the polymers. Ingredients A and B were introduced, in a compositing ratio between ingredient A and ingredient B of 50/50 by weight, into the spinneret, which was a spinneret for eccentric core-sheath composite fibers in which the number of ejection holes was 72. The two polymers met each other within the spinneret to form an eccentric core-sheath composite configuration in which the polymer of ingredient A was included in the polymer of ingredient B, and ejected from the spinneret. In the spinning of Example 1, a distribution plate type spinneret which gave eccentric core-sheath composite fibers such as that shown in FIG. 1 was used.

The filaments ejected from the spinneret were cooled with an air-cooling device, oiled, and wound up with a winder at a speed of 1,500 m/min to result in a spinning draft of 220. Thus, the filaments were stably wound up as a 150-dtex 72-filament unstretched yarn. In this operation, the position of the cooling initiation point was set at 97 mm from the spinneret ejection surface, and the oiling position was set at 1,130 mm from the spinneret ejection surface. This setting resulted in a spinning stress of 0.10 cN/dtex. Thus, diminution of longitudinal-direction fiber unevenness and stabilization of fiber formation were attempted.

Subsequently, the unstretched yarn obtained was sent to a stretching device at a speed of 300 m/min, stretched at a stretching temperature of 90° C. in a stretch ratio of 2.63 to result in an elongation of about from 20 to 40%, and then heat-set at 130° C. Thus, a 56-dtex 72-filament stretched yarn having a strength of 3.6 cN/dtex and an elongation of 32% was stably obtained through the spinning and stretching steps.

The eccentric core-sheath composite fibers obtained were evaluated, and the results thereof are shown in Table 1. The fiber cross-section had an S/D of 0.02, and the smallest-thickness portion accounted for 40% of the circumference of the fiber. The eccentric core-sheath composite fibers had a stretching elongation, which is an index to stretchability, of 63%. The fibers were bulky, were crimpy as if the fibers had undergone false twisting, and had sufficient stretchability. The fabric obtained from the yarn showed neither fibrillation nor whitening in the evaluation of wear resistance. This fabric was a novel one having an even appearance quality with no crinkles or streaks and having a smooth and delicate feeling.

TABLE 1

| | Polymers | | Areal compositing ratio (%) | | Composite configuration | | | | | Fiber formation stability |
|---|---|---|---|---|---|---|---|---|---|---|
| | Ingredient A | Ingredient B | Ingredient A | Ingredient B | Arrangement | Covering | S/D | Proportion of S (%) | IFR/R | |
| Example 1 | PBT1 | PET1 | 50 | 50 | eccentric | no exposure | 0.02 | 40 | 1.3 | excellent |
| Example 2 | 3GT | PET1 | 50 | 50 | eccentric | no exposure | 0.02 | 40 | 1.3 | excellent |
| Example 3 | PET2 | PET3 | 50 | 50 | eccentric | no exposure | 0.02 | 35 | 1.3 | good |
| Example 4 | coPET | PET3 | 50 | 50 | eccentric | no exposure | 0.02 | 45 | 1.2 | excellent |
| Example 5 | PBT1 | PET1 | 50 | 50 | eccentric | no exposure | 0.01 | 40 | 1.3 | excellent |
| Example 6 | PBT1 | PET1 | 50 | 50 | eccentric | no exposure | 0.08 | 40 | 1.3 | excellent |
| Example 7 | PBT1 | PET1 | 50 | 50 | eccentric | no exposure | 0.1 | 40 | 1.3 | excellent |
| Example 8 | PBT1 | PET1 | 40 | 60 | eccentric | no exposure | 0.03 | 35 | 1.3 | excellent |
| Example 9 | PBT1 | PET1 | 70 | 30 | eccentric | no exposure | 0.05 | 70 | 1.6 | excellent |
| Example 10 | PBT1 | PET1 | 30 | 70 | eccentric | no exposure | 0.02 | 30 | 1.2 | excellent |
| Example 11 | coPET | PET3 | 30 | 70 | eccentric | no exposure | 0.02 | 45 | 1.2 | excellent |
| Comparative Example 1 | PBT1 | PET1 | 50 | 50 | bonding | exposure | — | — | 5.0 | poor |
| Comparative Example 2 | PET2 | PET3 | 50 | 50 | bonding | exposure | — | — | 3.2 | poor |
| Comparative Example 3 | PBT1 | PET1 | 50 | 50 | eccentric | no exposure | 0.01 | 10 | 0.6 | excellent |
| Comparative Example 4 | PBT1 | PET1 | 30 | 70 | core-sheath | no exposure | 0.04 | 100 | 0.6 | excellent |

PBT1: poly(butylene terephthalate) (melt viscosity, 160 Pa · s)
PET1: poly(ethylene terephthalate) (melt viscosity, 140 Pa · s)
PET2: high-molecular-weight poly(ethylene terephthalate) (melt viscosity, 160 Pa · s)
PET3: low-molecular-weight poly(ethylene terephthalate) (melt viscosity, 70 Pa · s)
co-PET: poly(ethylene terephthalate) containing 7.0 mol % isophthalic acid and 4 mol % 2,2-bis(4-(2-hydroxyethoxy)phenyl)propane copolymerized (melt viscosity, 110 Pa · s)
3GT: poly(trimethylene terephthalate) (melt viscosity, 130 Pa · s)

Examples 2 to 11

Eccentric core-sheath composite fibers were obtained in the same manner as in Example 1, except that the combination of ingredient A and ingredient B (Examples 2 to 4), the value of S/D (Examples 5 to 7), and the compositing ratio (Examples 8 to 11) were changed as shown in Table 1. The eccentric core-sheath composite fibers obtained in each Example had sufficient stretchability and wear resistance and gave a fabric having an even appearance quality with no crinkles or streaks and having a smooth and delicate feeling.

Comparative Examples 1 to 4

Figure 5:
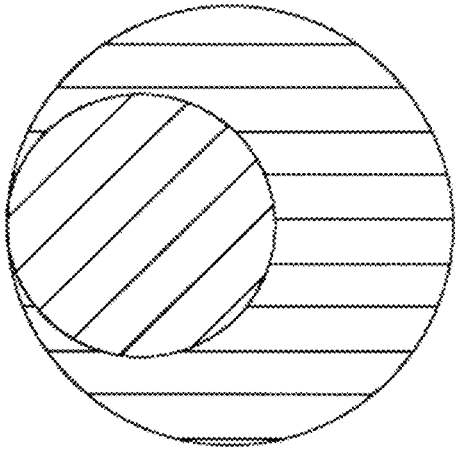
FIG. 5 shows an example of the cross-section of an eccentric core-sheath composite fiber which is outside the scope of our fibers.

The same procedure as in Example 1 was conducted, except that the spinneret described in JP-A-H09-157941 was used in Comparative Examples 1 and 2, a spinneret giving the same composite configuration as that shown in FIG. 5 was used in Comparative Example 3, and a conventional core-sheath composite spinneret was used in Comparative Example 4, as shown in Table 1. The flat yarns thus obtained were unsatisfactory.

TABLE 2

| | Single-filament Fineness (dtex) | Strength (cN/dtex) | Elongation (%) | Fineness Unevenness (U %) | Shrinkage stress Stress (cN/dtex) | Shrinkage stress Maximum-value Temperature (° C.) | Stretching elongation (%) | Evaluation of fabric | Wear resistance |
|---|---|---|---|---|---|---|---|---|---|
| Example 1 | 0.8 | 3.6 | 32 | 0.8 | 0.31 | 124 | 63 | good | A |
| Example 2 | 0.8 | 3.1 | 31 | 0.8 | 0.25 | 134 | 66 | good | A |
| Example 3 | 0.8 | 3.3 | 38 | 1.3 | 0.20 | 140 | 52 | good | A |
| Example 4 | 0.8 | 3.7 | 28 | 0.9 | 0.44 | 130 | 40 | good | A |
| Example 5 | 0.8 | 3.6 | 31 | 0.8 | 0.30 | 124 | 68 | good | B |
| Example 6 | 0.8 | 3.5 | 33 | 0.8 | 0.31 | 125 | 58 | good | A |
| Example 7 | 0.8 | 3.5 | 34 | 0.8 | 0.32 | 124 | 55 | good | A |
| Example 8 | 0.8 | 3.7 | 35 | 0.8 | 0.26 | 126 | 57 | good | A |
| Example 9 | 0.8 | 3.4 | 40 | 0.8 | 0.24 | 127 | 66 | good | A |
| Example 10 | 0.8 | 3.6 | 42 | 0.6 | 0.34 | 123 | 50 | good | A |
| Example 11 | 1.0 | 3.2 | 32 | 0.9 | 0.31 | 131 | 25 | good | A |
| Comparative Example 1 | 0.8 | 3.6 | 31 | 1.0 | 0.31 | 123 | 65 | poor | C |
| Comparative Example 2 | 0.8 | 3.7 | 30 | 2.1 | 0.27 | 126 | 58 | poor | C |
| Comparative Example 3 | 0.8 | 3.5 | 36 | 0.8 | 0.26 | 125 | 30 | poor | A |
| Comparative Example 4 | 0.8 | 3.7 | 31 | 0.6 | 0.25 | 126 | 0 | poor | A |

Example 12

Poly(butylene terephthalate) (PBT1) having a melt viscosity of 160 Pa·s and poly(ethylene terephthalate) (PET4) having a melt viscosity of 30 Pa·s were used respectively as ingredient A and ingredient B both for composite fibers for constituting a mixed-filament yarn, and a cation-dyeable PET (CD-PET1) obtained by copolymerizing 4.5% by weight dimethyl adipate and 0.4% by weight sodium-sulfoisophthalic acid with poly(ethylene terephthalate) was used for single-component fibers to be combined with the composite fibers. These polymers were separately melted, subsequently separately metered with pumps to the same spinning pack, and ejected through ejection holes formed in the spinneret, at a spinning temperature of 280° C. The shapes of the ejection holes for the composite fibers and for the single-component fibers were both round. In the spinneret used, the number of the ejection holes for the composite fibers, including PBT1 and PET4, was 24, and the number of the ejection holes for the single-component fibers was 48. The surface of this spinneret had a concentric hole arrangement in which the group of ejection holes for the composite fibers were surrounded by the group of ejection holes for the single-component fibers. The composite fibers in Example 12 were formed with the distribution plate shown in FIG. 7 so that ingredient A and ingredient B were composited in a ratio of 50/50 by weight to come to have a composite cross-section of the eccentric core-sheath type (FIG. 2) in which the polymer of ingredient A was included in the polymer of ingredient B. The spinning drafts (take-up speed/ejection-line speed) were regulated to 45 for the composite fibers and 101 for the single-component fibers by regulating the ejection hole diameters. The ejected filaments were cooled and solidified. Thereafter, all the single filaments were simultaneously collected and oiled and were then wound up at a spinning speed of 1,500 m/min. Thus, a 365-dtex 72-filament unstretched yarn was obtained (24 composite-fiber filaments; 48 single-component-fiber filaments).

Each composite polymer stream was ejected while being precisely controlled with the distribution plate shown in FIG. 7. As a result, the ejected polymer streams bent little just under the spinneret surface, and excellent ejection stability was attained.

Since the spinning temperature and the spinning drafts were properly regulated, the spinning was free from the fluffing caused by single-filament interference due to composite-fiber oscillation, and the winding was free from the single-filament sagging on the bobbin due to a difference in winding tension between the composite fibers and the single-component fibers. Thus, an unstretched-yam package having excellent appearance quality was able to be stably obtained. Subsequently, the wound unstretched yarn was stretched at a stretching speed of 600 m/min between rollers respectively heated to 90° C. and 150° C., thereby obtaining a 135-dtex 72-filament mixed-filament yarn (weight proportion of the composite fibers: 35% by weight). Because of the excellent appearance quality, the unstretched yarn suffered no single-filament breakage during the stretching step and showed stable stretchability. The stretched-yam package had an excellent appearance quality with no sagging or the like.

The mixed-filament yarn obtained had sufficient mechanical properties including a strength of 3.5 cN/dtex and an elongation of 34%, which rendered the yarn capable of withstanding practical use. The number of tangles was 4.4/m. An examination of cross-sections of the filament bundle revealed that the composite fibers had a proportion of adjacent-filament groups of 39%, showing that the mixed-filament yarn was excellent in terms of the dispersion of the composite fibers in the filament bundle while retaining suitable bundle characteristics capable of ensuring process passability in high-order processing.

A fabric was produced using the mixed-filament yarn and dyed. As a result, the composite fibers had a three-dimensional spiral structure, and the fabric had satisfactory stretchability (evaluation of stretchability: good). Furthermore, because of a difference in fiber length between the composite fibers and the single-component fibers and because of the effect wherein the composite fibers repelled each other due to the three-dimensional spiral structure thereof, the fabric had a puffy feeling and a smooth surface touch (evaluation of feeling: excellent). The dyed sample had an appearance in which the deeply dyed portions and the lightly dyed portions were moderately mellow, and had a natural grainy appearance which had not been attained so far and was aimed at by our fibers (evaluation of graininess: excellent). The results are shown in Table 4.

Examples 13 to 15

The same procedure as in described in Example 12 was conducted, except that the weight proportion of the composite fibers was stepwise changed to 45% by weight (Example 13), 50% by weight (Example 14), and 65% by weight (Example 15) by regulating the ejection rate.

The mixed-filament yarns of Examples 13 to 15 were each excellent in terms of filament running stability and the like and able to be wound up into a satisfactory package. These yarns were less apt to suffer troubles, for example, that single filaments were caught by the yarn guide and the like, and had high process passability even in high-order processing.

In Examples 13 to 15, the visibility of lightly dyed portions increased and the contrast between deeply dyed portions and lightly dyed portions became higher, as the weight proportion of the composite fibers in the mixed-filament yarn increased. Because of this, dyeing of fabrics obtained using these mixed-filament yarns gave the following results. In Example 13, the lightly dyed portions had reduced visibility and the dyed fabric had a mélange-looking grainy appearance in which the deeply dyed portions and the lightly dyed portions had finely mingled with each other. In Example 15, the lightly dyed portions had enhanced visibility although the deeply dyed portions and the lightly dyed portions had finely mingled with each other, and the dyed fabric hence had a wool-looking grainy appearance. The composite fibers showed high ability to form a three-dimensional spiral structure, and the dyed fabric of Example 15 was excellent in terms of stretchability and bulkiness. In Example 14, the dyed fabric had a grainy appearance intermediate between those in Example 13 and Example 15, which was a peculiar appearance wherein the lightly dyed portions had a gradation, and further had excellent stretchability. The results are shown in Table 4.

Examples 16 and 17

The same procedure as described in Example 12 was conducted, except that the arrangement of ejection holes for composite fibers and single-component fibers was changed to a zigzag lattice arrangement (Example 16) and a grouping arrangement (Example 17).

The mixed-filament yarns of Examples 16 and 17 each had a moderate number of tangles, was able to be wound up into a satisfactory package free from sagging and fluffing, and had high process passability in high-order processing.

In Example 16, since the arrangement of ejection holes had been of the zigzag lattice type, the mixed-filament yarn had a low proportion of adjacent-filament groups and the composite fibers were extremely satisfactorily dispersed therein. This mixed-filament yarn hence gave a fabric having an excellent touch. This fabric, after being dyed, had a characteristic menitone-looking grainy appearance in which the deeply dyed portions and the lightly dyed portions were extremely mellow.

In Example 17, since the arrangement of ejection holes had been a grouping arrangement, the mixed-filament yarn included composite fibers dispersed therein in a moderately gathered state, and the fabric had a grainy appearance having a high contrast between the deeply dyed portions and the lightly dyed portions. The results are shown in Table 4.

Examples 18 to 22

The same procedure as in Example 12 was conducted, except that the polymers of ingredient A and ingredient B to be used for composite fibers were replaced with the polymers shown in Table 3 and that spinning conditions and stretching conditions were set so that the Examples each yielded a mixed-filament yarn having an elongation of from 30 to 40%.

The mixed-filament yarn of Example 18 included composite fibers formed using high-viscosity PBT2 (melt viscosity, 250 Pa·s) as a high-shrinkage ingredient and hence having an increased crimpiness ratio. This yarn gave a fabric having excellent stretchability. The mixed-filament yarn of Example 18 had a proportion of adjacent-filament groups of 32%, showing that the composite fibers were satisfactorily dispersed. Because of this, the fabric obtained using this mixed-filament yarn, after being dyed, had a natural and mellow grainy appearance.

The mixed-filament yarn of Example 19 included composite fibers formed using high-viscosity PET5 (melt viscosity, 290 Pa·s) as a high-shrinkage ingredient and hence having a high Young's modulus. This yarn gave a fabric which had high stretch back properties and had a moderately tight and stiff sense. Meanwhile, since CO-PET2 had been used for single-component fibers, the composite fibers, which lay in the core position, showed high spinning stress in the fiber formation step to render the single-component fibers, which lay in the sheath position, less apt to be dispersed during filament collection. Because of this, the mixed-filament yarn had a slightly reduced proportion of adjacent-filament groups, although the proportion was not so low as to adversely affect the desired effect. The dyed fabric had a grainy appearance having an enhanced contrast between the deeply dyed portions and the lightly dyed portions.

The mixed-filament yarn of Example 20 included composite fibers formed using 3GT as a high-shrinkage ingredient and hence had soft and comfortable stretchability. Because of the low Young's modulus due to 3GT, a fabric having a soft feeling was obtained. Furthermore, since the mixed-filament yarn had a low proportion of adjacent-filament groups and the composite fibers were satisfactorily dispersed therein, the dyed fabric had a natural and mellow grainy appearance.

The mixed-filament yarn of Example 21 included composite fibers formed using PET6 (melt viscosity, 110 Pa·s) as a low-shrinkage ingredient, and hence had slightly reduced stretchability. However, the composite fibers had an increased Young's modulus. This mixed-filament yarn gave a fabric having tightness and stiffness. In Example 21, the proportion of adjacent-filament groups was slightly high and the composite fibers were dispersed to a reduced degree. Because of this, the fabric, after being dyed, had a grainy appearance having an enhanced contrast between the deeply dyed portions and the lightly dyed portions.

The mixed-filament yarn of Example 22 included composite fibers formed using PBT2 (melt viscosity, 250 Pa·s) as a high-shrinkage ingredient and PBT1 (melt viscosity, 160 Pa·s) as a low-shrinkage ingredient. Because of this, this mixed-filament yarn had not only stretchability due to a three-dimensional spiral structure but also stretchability due to the PBT polymers, and gave a fabric showing peculiar stretchability as compared with the fabrics obtained using the mixed-filament yarns shown in the other Examples. The results are shown in Table 4.

Example 23

The same procedure as in Example 12 was conducted, except that the ingredient A/ingredient B compositing ratio by weight was changed to 70/30 to change the ratio S/D, which was the ratio of the minimum thickness S of ingredient B, by which ingredient A was covered, to the diameter D of the single composite fibers.

Because of the high proportion of the high-shrinkage ingredient, considerable stress concentration on the high-shrinkage ingredient occurred in the spinning and stretching steps and the composite fibers had an increased crimpiness ratio. The mixed-filament yarn hence gave a fabric which, although having a slightly stiff feeling, had excellent stretchability. The results are shown in Table 4.

Examples 24 and 25

The same procedure as in Example 12 was conducted, except that an interlace nozzle was disposed just before the winding in the stretching step to perform filament-mixing/interlacing. In Example 24, the compressed-air pressure for the interlace nozzle was regulated to 0.20 MPa. In Example 25, the compressed-air pressure for the interlace nozzle was regulated to 0.40 MPa.

The number of tangles in the mixed-filament yarn in Example 24 was 45.0/m, and that in Example 25 was 85.6/m. Because of the increased number of tangles, the filaments had been highly satisfactorily bundled and each mixed-filament yarn obtained was able to be wound up into a satisfactory package free from sagging and fluffing. Furthermore, the composite fibers had been restrained by interlacing in the unopened portions, and the mixed-filament yarns were excellent in terms of suitability for hooking and the like in high-order processing.

In each of the mixed-filament yarns obtained, the composite fibers were satisfactorily dispersed. However, the opened portions of the filaments were higher in composite-fiber dispersion than the unopened portions, and the mixed-filament yarn had periodicity of composite-fiber dispersion according to the periodic disposition of the opened portions and unopened portions along the fiber axis direction. These mixed-filament yarns gave fabrics which, after being dyed, had a grainy appearance which included monochromatic-looking portions and had periodicity along the fiber axis direction because finely grainy portions and the densely or lightly dyed portions were highly dispersed in accordance with the periodic disposition of the opened portions and unopened portions.

Example 26

The method described in Example 1 was followed by twisting to impart 1,000 twists/m and twist setting with 80° C. steam. Due to the twisting of the mixed-filament yarn, the dyed fabric had a grainy appearance which was highly mellow with respect to the deeply dyed portions and the lightly dyed portions. Furthermore, the pitch of changes in color depth changed in the fiber axis direction, and this made the grainy appearance have deep or light dots. The results are shown in Table 4.

Example 27

PBT1 (melt viscosity, 160 Pa·s) and PET4 (melt viscosity, 30 Pa·s) were used respectively as ingredient A and ingredient B both for composite fibers for constituting a mixed-filament yarn, and CD-PET1 was used for single-component fibers to be combined with the composite fibers. These polymers were separately melted, subsequently separately metered with pumps to the same spinning pack, and ejected through ejection holes formed in the spinneret, at a spinning temperature of 280° C. The shapes of the ejection holes for the composite fibers and for the single-component fibers were both round. In the spinneret used, the number of the ejection holes for the composite fibers, to be configured of PBT1 and PET4, was 24, and the number of the ejection holes for the single-component fibers was 48. The surface of this spinneret had a concentric hole arrangement in which the group of ejection holes for the composite fibers were surrounded by the group of ejection holes for the single-component fibers. The composite fibers were formed to have a composite cross-section of the eccentric core-sheath type shown in FIG. 2. The ejected filaments were cooled and solidified. Thereafter, all the single filaments were simultaneously collected and oiled and were then wound up at a spinning speed of 3,000 m/min. Thus, a 140-dtex 72-filament partially oriented yarn was obtained.

The partially oriented yarn was preheated with a heater set at 180° C. and stretched at a stretching speed of 100 m/min, during which the yarn was false-twisted with friction disks. Thus, a 100-dtex 72-filament mixed-filament yarn was obtained (weight proportion of the composite fibers: 35% by weight).

Because of the excellent appearance quality of the partially oriented yarn before the false twisting, the partially oriented yarn suffered neither single-filament breakage nor fusion bonding between single filaments during the false twisting. The obtained mixed-filament yarn had excellent appearance quality free from defects such as fluffing and neps, and showed excellent process passability.

The obtained mixed-filament yarn had excellent bulkiness due to the false twisting combined with differences in fiber length between the composite fibers and the single-component fibers. This yarn gave a fabric having a bulky and puffy feeling. In addition, the false twisting had enlarged the interstices among the single filaments constituting the mixed-filament yarn and had made the composite fibers in the mixed-filament yarn apt to form a three-dimensional spiral structure. Consequently, the composite fibers had random crimped structures, and the fabric hence had excellent stretchability and had a characteristic surface touch. Furthermore, since the composite fibers in the mixed-filament yarn had been highly dispersed, the fabric, after being dyed, had a natural grainy feeling in which the deeply dyed portions and the lightly dyed portions were moderately mellow.

Example 28

The same procedure as in Example 27 was conducted, except that the false twisting step was performed in the following manner. The partially oriented yarn was unevenly stretched 1.20 times using a hot pin heated to 75° C., subsequently preheated with a heater set at 180° C., and stretched at a stretching speed of 100 m/min, during which the yarn was false-twisted with friction disks.

Because of the excellent appearance quality of the partially oriented yarn before the uneven stretching and false twisting, the partially oriented yarn was free from winding around the hot pin and suffered neither single-filament breakage nor single-filament fusion bonding both due to abrasion with the heater. The obtained mixed-filament yarn had excellent appearance quality free from defects such as fluffing and neps, and showed excellent process passability. Besides having differences in color depth due to dyeing between the single-component fibers and the composite fibers, the mixed-filament yarn had differences in color depth between stretched portions and unstretched portions as a result of the uneven stretching, the color-depth differences having been randomly distributed along the fiber axis direction. The fabric had a color-depth pitch also along the fiber axis direction and had multicolored graininess.

Comparative Example 5

The same procedure as in Example 14 was conducted, except the following. PBT1 (melt viscosity, 160 Pa·s) and PET4 (melt viscosity, 30 Pa·s) were used as polymers for composite fibers, and CD-PET1 was used as a polymer for single-component fibers. The composite fibers and the single-component fibers were separately spun, and each kind of the unstretched fibers was temporarily wound up at a spinning speed of 1,500 m/min. The composite fibers and the single-component fibers were fed to a stretching machine while being put together. Stretching with fiber mixing was thus conducted to obtain a mixed-filament yarn by after-mixing, which included the composite fibers and the single-component fibers (135-dtex, 72-filament; weight proportion of the composite fibers, 50% by weight).

The obtained mixed-filament yarn had a proportion of adjacent-filament groups as extremely high as 88%, and the composite fibers and the single-component fibers were poorly dispersed. When the mixed-filament yarn obtained by after-mixing was unreeled from the bobbin, the composite fibers immediately separated from the single-component fibers to form coarse sagging. Because of this, there were instances where crinkles or uneven dyeing occurred in portions where the proportion of composite fibers was high, if feeding of the yarn in weaving was not precisely controlled.

Dyeing a fabric produced using the mixed-filament yarn obtained by after-mixing gave a dyed fabric which, although having stretchability, had clear white streaks having a long pitch. Portions where single fibers of one kind localized and floated on the fabric surface had a rough touch. The results are shown in Table 4.

Comparative Example 6

The same procedure as in Example 12 was conducted, except the following. PBT1 (melt viscosity, 160 Pa·s) and PET4 (melt viscosity, 30 Pa·s) were used as polymers for composite fibers, and CD-PET1 was used as a polymer for single-component fibers. The composite fibers and the single-component fibers were separately spun, and the unstretched fibers of each kind were temporarily wound up at a spinning speed of 1,500 m/min. The composite fibers and the single-component fibers were separately fed to a stretching machine to thereby obtain stretched composite fibers and stretched single-component fibers. Subsequently, the composite fibers and the single-component fibers were put together and then subjected to filament-mixing/interlacing with an interlace nozzle (compressed-air pressure: 0.5 MPa) to obtain a mixed-filament interlaced yarn (135-dtex, 72-filament; weight proportion of the composite fibers, 35% by weight).

The mixed-filament interlaced yarn obtained had no single-fiber sagging on the bobbin because the yarn had been highly interlaced (number of tangles: 108.0/m). A fabric produced using the mixed-filament interlaced yarn had no problem concerning stretchability but, upon dyeing, came to have clear white streaks having a long pitch. The fabric included portions where one kind of single fibers localized and the surface had a rough touch. The fabric did not have a satisfactory feeling. The results are shown in Table 4.

Comparative Example 7

The method described in Comparative Example 6 was followed by twisting to impart 1,000 twists/m and twist setting with 80° C. steam, thereby obtaining a mixed-filament twisted yarn. The mixed-filament twisted yarn gave a fabric which had white streaks having a reduced pitch. However, this fabric had an excessively high contrast between deeply dyed portions and lightly dyed portions and did not have a natural grainy appearance such as ones attained by our fibers.

Comparative Example 8

The same procedure as in Example 16 was conducted, except that PET6 (melt viscosity, 110 Pa·s) was used as both ingredient A and ingredient B to obtain PET6 single-component fibers, that CD-PET2, which had been obtained by copolymerizing 0.3% by weight sodiumsulfoisophthalic acid and 1.0% by weight polyethylene glycol with poly (ethylene terephthalate), was used as a cation-dyeable PET, and that the spinning temperature was changed to 290° C. Thus, a mixed-filament false-twisted yarn including PET6 single-component fibers and CD-PET2 single-component fibers was obtained (100-dtex, 72-filament; weight proportion of the PET6 single-component fibers, 35% by weight).

The mixed-filament false-twisted yarn had little stretchability and low bulkiness because no composite fibers were included therein. This yarn was poor in feeling (touch) as compared to our mixed-filament yarns. The proportion of adjacent-filament groups was 92%, showing that the single fibers were poorly dispersed in the fiber bundle. Upon dyeing, the fabric came to have an appearance including white streaks having a short pitch. However, the appearance was an unnatural grainy appearance having too high a contrast between deeply dyed portions and lightly dyed portions.

TABLE 3

| | Polymers | | | Weight proportion | | | Cross-section of composite fiber | |
|---|---|---|---|---|---|---|---|---|
| | Ingredient A | Ingredient B | Single-component fibers | Composite fibers (wt %) | Filament mixing method | Arrangement of ejection holes | S/D | Proportion of S (%) |
| Example 12 | PBT1 | PET4 | CD-PET1 | 35 | spinning/filament mixing | core-sheath | 0.027 | 46 |
| Example 13 | PBT1 | PET4 | CD-PET1 | 45 | spinning/filament mixing | core-sheath | 0.041 | 45 |
| Example 14 | PBT1 | PET4 | CD-PET1 | 50 | spinning/filament mixing | core-sheath | 0.031 | 40 |
| Example 15 | PBT1 | PET4 | CD-PET1 | 65 | spinning/filament mixing | core-sheath | 0.038 | 41 |
| Example 16 | PBT1 | PET4 | CD-PET1 | 35 | spinning/filament mixing | zigzag lattice | 0.027 | 46 |
| Example 17 | PBT1 | PET4 | CD-PET1 | 35 | spinning/filament mixing | grouping | 0.027 | 46 |
| Example 18 | PBT2 | PET4 | CD-PET1 | 35 | spinning/filament mixing | core-sheath | 0.028 | 40 |
| Example 19 | PET5 | PET4 | CD-PET2 | 35 | spinning/filament mixing | core-sheath | 0.024 | 44 |
| Example 20 | 3GT | PET4 | CD-PET1 | 35 | spinning/filament mixing | core-sheath | 0.028 | 47 |
| Example 21 | PBT1 | PET6 | CD-PET1 | 35 | spinning/filament mixing | core-sheath | 0.020 | 38 |
| Example 22 | PBT2 | PBT1 | CD-PET1 | 35 | spinning/filament mixing | core-sheath | 0.023 | 48 |
| Example 23 | PBT1 | PET4 | CD-PET1 | 35 | spinning/filament mixing | core-sheath | 0.010 | 54 |
| Example 24 | PBT1 | PET4 | CD-PET1 | 35 | spinning/filament mixing + interlacing | core-sheath | 0.027 | 46 |
| Example 25 | PBT1 | PET4 | CD-PET1 | 35 | spinning/filament mixing + interlacing | core-sheath | 0.027 | 46 |
| Example 26 | PBT1 | PET4 | CD-PET1 | 35 | spinning/filament mixing + twisting | core-sheath | 0.027 | 46 |
| Example 27 | PBT1 | PET4 | CD-PET1 | 35 | spinning/filament mixing + false twisting | core-sheath | 0.027 | 46 |
| Example 28 | PBT1 | PET4 | CD-PET1 | 35 | spinning/filament mixing | core-sheath | 0.027 | 46 |
| Comp. Ex. 5 | PBT1 | PET4 | CD-PET1 | 50 | stretching with mixing | — | — | — |
| Comp. Ex. 6 | PBT1 | PET4 | CD-PET1 | 35 | interlacing | — | — | — |
| Comp. Ex. 7 | PBT1 | PET4 | CD-PET1 | 35 | interlacing + twisting | — | — | — |
| Comp. Ex. 8 | PET6 | — | CD-PET2 | — | interlacing + false twisting | — | — | — |

PBT1: poly(butylene terephthalate) (melt viscosity, 160 Pa · s)

PBT2: poly(butylene terephthalate) (melt viscosity, 250 Pa · s)

PET4: poly(ethylene terephthalate) (melt viscosity, 30 Pa · s)

PET5: high-molecular-weight poly(ethylene terephthalate) (melt viscosity, 290 Pa · s)

PET6: poly(ethylene terephthalate) (melt viscosity, 110 Pa · s)

3GT: poly(trimethylene terephthalate) (melt viscosity, 130 Pa · s)

CD-PET1: poly(ethylene terephthalate) containing 4.5 wt % adipic acid and 0.4 mol % sodium sulfoisophthalate copolymerized (melt viscosity, 110 Pa · s)

CD-PET2: poly(ethylene terephthalate) containing 1.0 wt % polyethylene glycol and 0.3 mol % sodium sulfoisophthalate copolymerized (melt viscosity, 200 Pa · s)

TABLE 4

| | Strength (cN/dtex) | Elongation (%) | Proportion of adjacent-filament groups(%) | Number of tangles(/m) | Evaluation of fabric | | |
|---|---|---|---|---|---|---|---|
| | | | | | Stretchability | Feeling | Graininess |
| Example 12 | 3.5 | 34 | 39 | 4.4 | good | excellent | excellent |
| Example 13 | 3.1 | 33 | 32 | 3.6 | good | excellent | excellent |
| Example 14 | 3.0 | 36 | 27 | 3.8 | excellent | excellent | good |
| Example 15 | 3.0 | 37 | 30 | 3.3 | excellent | excellent | good |
| Example 16 | 3.5 | 36 | 21 | 6.0 | good | excellent | excellent |
| Example 17 | 3.3 | 31 | 49 | 3.1 | good | good | good |
| Example 18 | 3.1 | 35 | 32 | 4.1 | excellent | good | excellent |
| Example 19 | 3.6 | 32 | 47 | 2.9 | excellent | good | good |
| Example 20 | 3.1 | 35 | 31 | 5.5 | excellent | excellent | excellent |
| Example 21 | 3.6 | 34 | 45 | 1.8 | good | good | good |
| Example 22 | 3.3 | 32 | 38 | 4.7 | excellent | excellent | good |
| Example 23 | 3.5 | 35 | 41 | 3.3 | excellent | good | excellent |
| Example 24 | 3.4 | 33 | 29 | 45.0 | good | excellent | excellent |
| Example 25 | 3.1 | 29 | 21 | 85.6 | good | good | excellent |
| Example 26 | 3.5 | 34 | 39 | 14.4 | good | good | excellent |
| Example 27 | 2.6 | 38 | 25 | 24.3 | excellent | excellent | excellent |
| Example 28 | 2.5 | 37 | 23 | 22.6 | excellent | excellent | excellent |
| Comp. Ex. 5 | 3.5 | 32 | 88 | 0 | good | poor | poor |
| Comp. Ex. 6 | 2.7 | 35 | 80 | 108.0 | good | poor | fair |
| Comp. Ex. 7 | 2.7 | 35 | 80 | 115.0 | good | poor | fair |
| Comp. Ex. 8 | 2.2 | 25 | 92 | 43.2 | poor | poor | fair |

While our fibers, yarns and methods have been described in detail and with reference to specific examples thereof, it will be apparent to one skilled in the art that various changes and modifications can be made therein without departing from the spirit and scope thereof. This application is based on a Japanese patent application filed on Dec. 14, 2016 (Application No. 2016-242514) and a Japanese patent application filed on May 30, 2017 (Application No. 2017-106632), the entire contents thereof being incorporated herein by reference.

INDUSTRIAL APPLICABILITY

This fabric is a material having sufficient stretchability and wear resistance and having an even and smooth appearance free from crinkles and streaks. This fabric can be extensively utilized in applications such as sports clothing and outer wear materials and is suitable for a wide range of uses as a new material having a novel delicate touch and a soft feeling. This material is suitable not only for applications such as outdoor clothing and sports clothing including swimming wear but also general clothing applications.

This mixed-filament yarn can give woven or knit fabrics which have sufficient stretchability and, despite this, have a puffy and comfortable feeling and a natural-looking appearance. The woven or knit fabrics can be extensively used in applications ranging from sports clothing, which is required to have stretchability and aesthetic properties, to general apparel clothing, including inner and outer wear. Novel natural-fiber-looking stretch materials can be provided with satisfactory production efficiency.

The invention claimed is:

1. An eccentric core-sheath composite fiber comprising two kinds of polymers that are ingredient A and ingredient B, the eccentric core-sheath composite fiber having a fineness unevenness (U %) of 1.5% or less, and a single-filament fineness of 0.8 dtex or less, wherein the ingredient B is poly(ethylene terephthalate), and in a cross-section of the composite fiber:

the ingredient A is a polyester selected from PBT, 3GT, PET and coPET, and is covered entirely by the ingredient B;

a ratio S/D of a minimum thickness S of a thickness of the ingredient B that covers the ingredient A, to a fiber diameter D is 0.01 to 0.1;

a portion where the ingredient B has a thickness up to 1.05 times the minimum thickness S has a peripheral length of at least one-third of an entire circumferential length of the fiber; and a fiber cross-section satisfies expression (1), wherein IFR is a radius of curvature of an interface between ingredient A and ingredient B in the fiber cross-section and R is a value obtained by dividing the fiber diameter D by 2, $(IFR/R) \geq 1$ expression (1);

wherein the fiber has improved feeling and graininess.

2. The eccentric core-sheath composite fiber according to claim 1, having a stretching elongation of 20 to 70%, wherein at least one of the two ingredients is a polyester.

3. A mixed-filament yarn comprising two or more kinds of single filaments having different cross-sectional configuration and dispersedly intermingled with each other, wherein:

at least one kind of the single filaments comprises the eccentric core-sheath composite fiber according to claim 1 comprising a combination of two polymers differing in melt viscosity by 50 Pa·s or more; and the at least one kind of the single filaments is bundled with the other of the single filaments with the number of tangles being 1 to 100/m.

4. A mixed-filament yarn comprising two or more kinds of single filaments having different cross-sectional configuration and dispersedly intermingled with each other, wherein:

at least one kind of the single filaments comprises a composite fiber according to claim 1 comprising a combination of two polymers differing in melt viscosity by 50 Pa·s or more;

the composite fiber has an eccentric core-sheath composite cross-section;

a proportion of adjacent-filament groups for the at least one kind of the single filaments is 10 to 50%; and the at least one kind of the single filaments is bundled with the other of the single filaments with the number of tangles being 1 to 100/m.

5. The mixed-filament yarn according to claim 4, wherein the composite fiber has a three-dimensional spiral structure.

6. The mixed-filament yarn according to claim 4, wherein the other of the single filaments is a single-component fiber constituted of a single component.

7. The mixed-filament yarn according to claim 4, wherein the composite fiber accounts for 30% or more and 80% or less by weight of the mixed-filament yarn.

8. A fibrous product comprising the mixed-filament yarn according to claim 3 as at least a part of the fibrous product.

* * * * *